US012385710B2

(12) United States Patent
Dwyer et al.

(10) Patent No.: US 12,385,710 B2
(45) Date of Patent: Aug. 12, 2025

(54) GUN ATTACHMENT

(71) Applicant: Biofire Technologies Inc., Broomfield, CO (US)

(72) Inventors: Benjamin William Dwyer, Golden, CO (US); Kai Thorin Kloepfer, Denver, CO (US); Bryan Edward Rogers, Aurora, CO (US); Donna Kelley, Louisville, CO (US); Jack Hugo Thiesen, Firestone, CO (US); Christopher James Owens, Denver, CO (US)

(73) Assignee: Biofire Technologies Inc., Broomfield, CO (US)

( * ) Notice: Subject to any disclaimer, the term of this patent is extended or adjusted under 35 U.S.C. 154(b) by 0 days.

(21) Appl. No.: 18/586,304

(22) Filed: Feb. 23, 2024

(65) Prior Publication Data

US 2024/0247902 A1 Jul. 25, 2024

Related U.S. Application Data

(62) Division of application No. 17/661,002, filed on Apr. 27, 2022, now Pat. No. 11,913,744.
(Continued)

(51) Int. Cl.
*F41A 21/32* (2006.01)
*F41G 1/34* (2006.01)
(Continued)

(52) U.S. Cl.
CPC ..... *F41A 21/32* (2013.01); *F41G 1/345* (2013.01); *F41G 11/003* (2013.01); *F41C 3/00* (2013.01); *F41G 1/02* (2013.01)

(58) Field of Classification Search
CPC ..... F41A 21/32; F41A 21/325; F41A 21/34; F41A 21/36; F41A 21/38; F41A 21/30
See application file for complete search history.

(56) References Cited

U.S. PATENT DOCUMENTS 3,114,289 A 12/1963 Aulabaugh
4,479,418 A 10/1984 Beretta
(Continued)

FOREIGN PATENT DOCUMENTS

WO 2003076863 9/2003

OTHER PUBLICATIONS

"International Search Report and Written Opinion" mailed on Jan. 25, 2023, for International Application No. PCT/US2022/071959; 20 pages.

*Primary Examiner* — Jonathan C Weber
(74) *Attorney, Agent, or Firm* — Perkins Coie LLP; Andrew T. Pettit

(57) ABSTRACT

The present disclosure provides systems and techniques for an attachment that can be fastened to a gun. The attachment may include a top surface having a longitudinal axis and an aiming sight that is parallel with the longitudinal axis, a front surface having a latitudinal axis that is perpendicular to the longitudinal axis, the front surface including a muzzle aperture, a left surface, a right surface, and a fastening system. The fastening system may include a first mounting aperture of the left surface, a second mounting aperture of the right surface, and a locking pin capable of being positioned in the first mounting aperture and in the second mounting aperture such that the locking pin fastens the attachment to the gun. The attachment may be fastened to the gun such that the longitudinal axis is parallel with a longitudinal bore axis of the gun.

7 Claims, 14 Drawing Sheets

Related U.S. Application Data

(60) Provisional application No. 63/180,581, filed on Apr. 27, 2021.

(51) Int. Cl.

| | |
|---|---|
| ***F41G 11/00*** | (2006.01) |
| *F41C 3/00* | (2006.01) |
| *F41G 1/02* | (2006.01) |

(56) References Cited

U.S. PATENT DOCUMENTS

| | | | | |
|---|---|---|---|---|
| 4,893,544 | A | 1/1990 | Hawley et al. | |
| 5,068,968 | A | 12/1991 | Sillery | |
| 5,735,070 | A | 4/1998 | Vasquez et al. | |
| 7,194,836 | B1 | 3/2007 | Urban | |
| 7,578,090 | B1 | 8/2009 | Romaszka | |
| 8,371,729 | B2 | 2/2013 | Sharrah et al. | |
| 8,631,602 | B2 * | 1/2014 | Chupp | F41C 27/00 42/71.02 |
| 9,482,483 | B2 | 11/2016 | Whelan | |
| 9,879,934 | B2 | 1/2018 | Thomas et al. | |
| 10,054,381 | B1 * | 8/2018 | Heizer | F41A 11/00 |
| 10,101,107 | B1 * | 10/2018 | Huang | F41A 3/66 |
| 10,161,704 | B1 | 12/2018 | Lee | |
| 10,254,085 | B2 | 4/2019 | Willmann et al. | |
| 10,605,550 | B1 * | 3/2020 | Heizer | F41A 3/66 |
| 10,612,878 | B1 | 4/2020 | Salvador | |
| 10,788,286 | B2 | 9/2020 | Molina | |
| 10,866,042 | B1 * | 12/2020 | Huang | F16B 21/165 |
| 2014/0190051 | A1 | 7/2014 | Wichner | |
| 2015/0308768 | A1 * | 10/2015 | Mills | F41A 11/04 42/75.03 |
| 2015/0362276 | A1 | 12/2015 | Fischer | |
| 2016/0209149 | A1 | 7/2016 | Fischer | |
| 2017/0205178 | A1 * | 7/2017 | Niswander | F41A 21/325 |
| 2018/0017352 | A1 | 1/2018 | Addis | |
| 2018/0195835 | A1 | 7/2018 | Crispin et al. | |
| 2018/0347933 | A1 * | 12/2018 | Molina | F41A 35/02 |
| 2019/0101350 | A1 | 4/2019 | Hall et al. | |
| 2019/0242668 | A1 * | 8/2019 | Barrett | F41A 21/28 |
| 2021/0131764 | A1 | 5/2021 | Padovan | |
| 2021/0222998 | A1 | 7/2021 | Theisinger et al. | |
| 2023/0228515 | A1 * | 7/2023 | Roe | F41A 21/325 89/14.05 |
| 2024/0110758 | A1 * | 4/2024 | Roe | F41A 21/325 |

* cited by examiner

100

800

1000

1100

1200

1300

1400

GUN ATTACHMENT

CROSS-REFERENCE TO RELATED APPLICATIONS

This application is a divisional of U.S. patent application Ser. No. 17/661,002, titled "Gun Attachment" and filed Apr. 27, 2022, now U.S. Pat. No. 11,913,744, which claims priority to US Provisional Application No. 63/180,581, titled "DYNAMIC GUN ATTACHMENT" and filed on Apr. 27, 2021, which are incorporated by reference herein in their entireties.

FIELD OF TECHNOLOGY

The teachings disclosed herein generally relate to guns, and more specifically to attachments for guns.

BACKGROUND

The term "gun" generally refers to a ranged weapon that uses a shooting tube (also referred to as a "barrel") to launch solid projectiles, though some instead project pressurized liquid, gas, or even charged particles. These projectiles may be free flying (e.g., as with bullets), or these projectiles may be tethered to the gun (e.g., as with spearguns, harpoon guns, and electroshock weapons such as TASER® devices). The means of projectile propulsion vary according to the design (and thus, type of gun), but are traditionally effected pneumatically by a highly compressed gas contained within the barrel. This gas is normally produced through the rapid exothermic combustion of propellants (e.g., as with firearms) or mechanical compression (e.g., as with air guns). When introduced behind the projectile, the gas pushes and accelerates the projectile down the length of the barrel, imparting sufficient launch velocity to sustain it further towards a target after exiting the muzzle.

Most guns use compressed gas that is confined by the barrel to propel the projectile up to high speed, though the term "gun" may be used more broadly in relation to devices that operate in other ways. Accordingly, the term "gun" may not only cover handguns, shotguns, rifles, single-shot firearms, semi-automatic firearms, and automatic firearms, but also electroshock weapons, light-gas guns, plasma guns, and the like.

Significant energies have been spent developing safer ways to use, transport, store, and discard guns. Gun safety is an important aspect of avoiding unintentional injury due to mishaps like accidental discharges and malfunctions. Gun safety is also becoming an increasingly important aspect of designing and manufacturing guns. While there have been many attempts to make guns safer to use, transport, and store, those attempts have had little impact.

SUMMARY

The systems, apparatuses, and techniques described herein support an attachment that can be fastened to a gun. The term "gun," as used herein, may be used to refer to a lethal force weapon, such as a pistol, a rifle, a shotgun, a semi-automatic firearm, or an automatic firearm; a less-lethal weapon, such as a stun-gun or a projectile emitting device; or an assembly of components operable to selectively discharge matter or charged particles, such as a firing mechanism.

Generally, the described systems and techniques described herein provide an attachment that can be fastened to a gun. The attachment improves shooter accuracy and gun personalization by delivering stationary sights and a personalized platform. The attachment may include a top surface having a longitudinal axis and an aiming sight that is parallel with the longitudinal axis, a front surface having a latitudinal axis that is perpendicular to the longitudinal axis, the front surface including a muzzle aperture, a left surface, a right surface, and a fastening system. The left surface and the right surface may extend from the front surface in a direction that is parallel with the longitudinal axis. The fastening system may include a first mounting aperture of the left surface, a second mounting aperture of the right surface, and a locking pin capable of being positioned in the first mounting aperture and in the second mounting aperture such that the locking pin fastens the attachment to the gun. Fastening the attachment to the gun may result in the longitudinal axis being parallel with a longitudinal bore axis of the gun, and the muzzle aperture may be centered around the longitudinal bore axis of the gun such that the gun can fire projectile through the bore and through the muzzle aperture.

Figure 1:
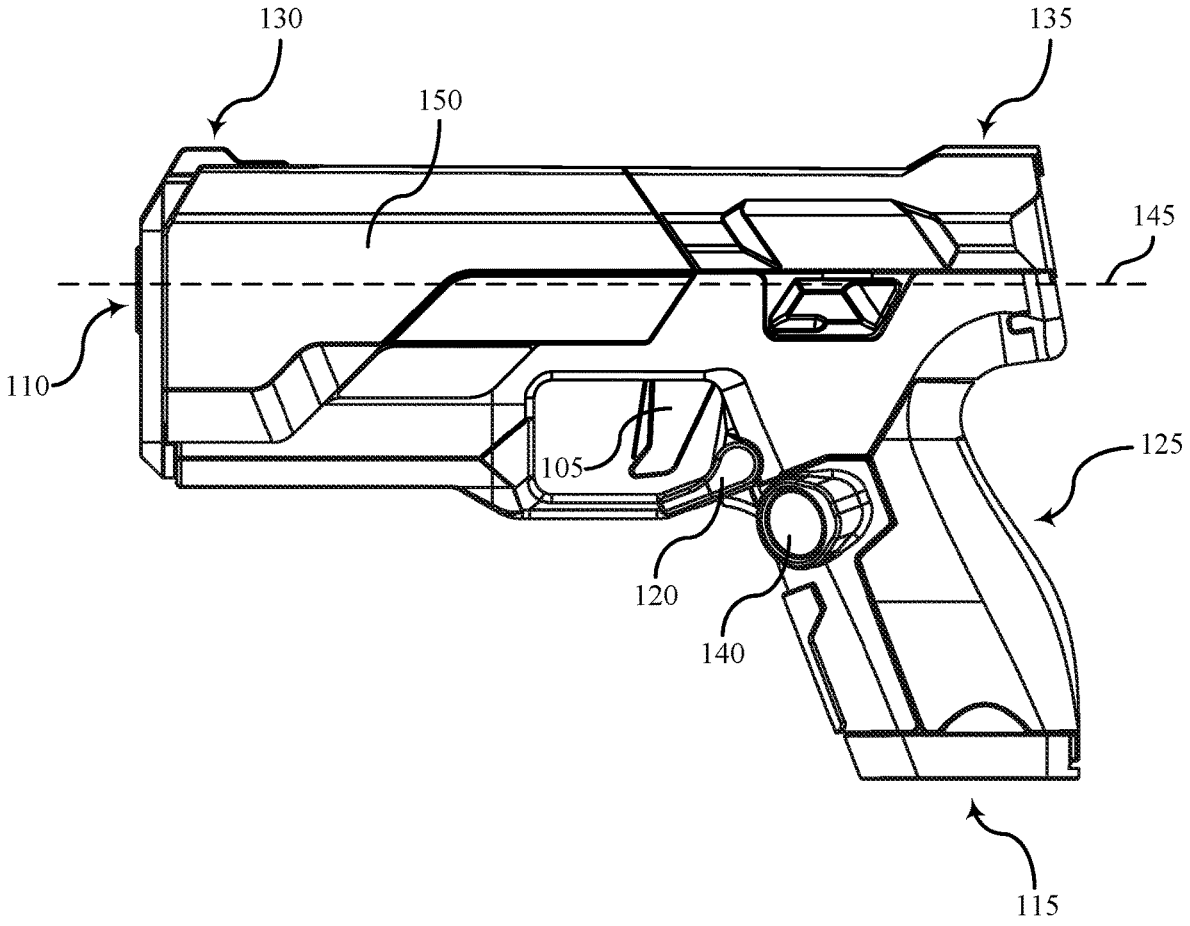
FIG. 1 illustrates an example of a gun that can be coupled with an attachment.

Various features of the technology described herein will become more apparent to those skilled in the art from a study of the Detailed Description in conjunction with the drawings. Various embodiments are depicted in the drawings for the purpose of illustration. However, those skilled in the art will recognize that alternative embodiments may be employed without departing from the principles of the technology. Accordingly, the technology is amenable to modifications that may not be reflected in the drawings.

DETAILED DESCRIPTION

Some conventional guns provide one or more aiming sights (or simply "sights") that are mounted on top of the slide. The sights are used to aim the gun at a target, but since the sights are generally located on the slide, the sights will reciprocate every time the gun is fired. This reciprocation makes it challenging to deliver accurate shots in rapid succession, as the sights reciprocate out of the sight picture of the user firing the gun, so the user must wait for the slide to return to battery for the sights to reenter the sight picture before aligning the sights with the target for a follow up shot.

Additionally, personalizing a gun can be time consuming and prevent the gun from functioning as expected. For example, a user may personalize a gun by attaching peripheral components to the gun, such as a flashlight, a laser sight, an optical sight, a suppressor, a compensator, or the like. But attaching such peripheral components may prevent the gun from functioning as expected or impose significant loads onto the gun that can damage the gun. For example, attaching a flashlight to a pistol may prevent the pistol from fitting in a holster, and shooting a pistol with a suppressor may prevent the gun from ejecting spent cartridges or increase the wear on the recoil spring.

Introduced here, therefore, is a gun attachment that delivers stationary aiming sights while providing a platform for easily and reliably personalizing the gun. The gun attachment (or simply "attachment") described herein may be removably coupled with a gun. Note that the attachment may vary in its design and construction depending on the type of gun to which it is to be removably coupled. For the purpose of illustration, embodiments of the attachment may be shown (and therefore described) in the context of a semi-automatic pistol. Embodiments of the attachment could be similarly designed for other types of guns, however.

The attachment may include a front sight, and the attachment may be coupled with a gun such that the front sight is located above the barrel of the gun while the gun is held in an upright position, where the phrase "upright position" generally refers to a scenario in which the gun is oriented as if in a high ready position with the barrel roughly parallel to the ground. The attachment may be coupled with the gun such that the slide can move freely while the attachment remains stationary, thereby improving the degree to which the user operating the gun can keep the front sight in their sight picture.

The attachment also provides a platform for personalizing the appearance and behavior of the gun. For example, the attachment may include integrated peripheral components or attachment mechanisms for affixing peripheral components. The term "peripheral component" generally refers to a component that can function independently from a firing mechanism of the gun. The attachment may include an integrated peripheral component, such as a laser sight, a fiber optic sight, a light-emitting diode (LED) sight, or a flashlight. The attachment may additionally or alternatively be removably coupled with a peripheral component, such as a flashlight, a laser sight, a suppressor, or a compensator. The attachment may include an electrical interface that allows the attachment to be electronically coupled with a gun. For example, the attachment may include a universal serial bus (USB) interface that is mated with a corresponding USB interface of the gun as the attachment is affixed to the gun.

The attachment may be removably coupled with the gun. For example, a locking pin may be used to fasten the attachment to a frame or chassis of the gun, and the attachment may be removed from the gun based on removing the locking pin. The attachment may include guide rods that align the attachment with the gun such that the electrical interface of the attachment reliably mates with the electrical interface of the gun, such that the aiming sight is positioned in an appropriate location to facilitate accurate aiming, or such that an aperture of the attachment is aligned with a bore of the barrel of the gun. A gun may be personalized by removing a first attachment and affixing a second attachment to the gun. The first and second attachments may be different colors and/or include different peripheral components. The gun may also be personalized by affixing a peripheral component to the attachment, such as a flashlight, a suppressor, or a compensator. The attachments described herein may be capable of being used with multiple different guns. For example, an attachment mechanism may be designed for a style of gun or a model of gun, and the attachment may be used with multiple guns of a particular style or model.

In some examples, the attachment may include an alloy chassis at a front end of the attachment body. For example, the left and right sides of the attachment may include a synthetic polymer shroud, and the front of the attachment may include a heat resistive alloy chassis that aids in directing hot gas away from the gun. The chassis may include a hole that lines up with the bore of the barrel when the attachment is coupled with a gun. The chassis may include a flat surface that is perpendicular to a longitudinal axis of the barrel as well as a recessed surface that extends from the flat surface and along the longitudinal axis of the barrel in a negative direction for at least 12 millimeters. The recessed surface may be a tapered cylinder that surrounds the barrel and promotes the egress of gas away from the barrel. In some examples, the length of the recessed surface is configured to be longer than the distance traveled by the barrel during recoil.

The attachment chassis may include threading that allows peripheral components to be connected to the attachment, such as suppressors or compressors. For example, the attachment may include a raised surface that extends from the flat surface along the longitudinal axis of the barrel in a positive direction. The positive direction of the longitudinal axis corresponds to the direction a projectile fired from the gun would travel, and the negative direction is the opposite direction. The raised surface may include threading that supports the coupling of a suppressor, a compensator, or an adapter mechanism. The attachment described herein allows a suppressor, compensator, or adapter mechanism to be coupled with the gun in a static fashion that, thereby reducing the load applied onto the barrel of the gun.

Embodiments may be described in the context of executable instructions for the purpose of illustration. For example, a processor housed in a gun may be described as being capable of executing instructions that manages the behavior of the attachment. As an example, the processor may transmit signals over a physical communication channel to cause an LED sight, a laser sight, or a flashlight to power on. However, those skilled in the art will recognize that aspects of the technology could be implemented via hardware, firmware, or software.

Terminology

References in the present disclosure to "an embodiment" or "some embodiments" means that the feature, function, structure, or characteristic being described is included in at least one embodiment. Occurrences of such phrases do not necessarily refer to the same embodiment, nor do they necessarily refer to alternative embodiments that are mutually exclusive of one another.

Unless the context clearly requires otherwise, the terms "comprise," "comprising," and "comprised of" are to be construed in an inclusive sense rather than an exclusive or exhaustive sense (i.e., in the sense of "including but not limited to"). The term "based on" is also to be construed in an inclusive sense rather than an exclusive or exhaustive sense. For example, the phrase "A is based on B" does not imply that "A" is based solely on "B." Thus, the term "based on" is intended to mean "based at least in part on" unless otherwise noted.

The terms "connected," "coupled," and variants thereof are intended to include any connection or coupling between two or more elements, either direct or indirect. The connection or coupling can be physical, electrical, logical, or a combination thereof. For example, elements may be electrically or communicatively coupled with one another despite not sharing a physical connection. As one illustrative example, a first component is considered coupled with a second component when there is a conductive path between the first component and the second component. As another illustrative example, a first component is considered coupled with a second component when the first component and the second component are fastened, joined, attached, tethered, bonded, or otherwise linked.

The term "manager" may refer broadly to software, firmware, or hardware. Managers are typically functional components that generate one or more outputs based on one or more inputs. A computer program may include or utilize one or more managers. For example, a computer program may utilize multiple managers that are responsible for completing different tasks, or a computer program may utilize a single manager that is responsible for completing all tasks. As another example, a manager may include an electrical circuit that produces an output based on hardware components, such as transistors, logic gates, analog components, or digital components. Unless otherwise noted, the terms "manager" and "module" may be used interchangeably herein.

When used in reference to a list of multiple items, the term "or" is intended to cover all of the following interpretations: any of the items in the list, all of the items in the list, and any combination of items in the list. For example, the list "A, B, or C" indicates the list "A" or "B" or "C" or "A and B" or "A and C" or "B and C" or "A and B and C."

Overview of Guns

FIG. 1 illustrates an example of a gun 100 that can be coupled with an attachment in accordance with aspects of the present disclosure. The gun 100 includes a trigger 105, a barrel 110, a magazine 115, and a magazine release 120. While these components are generally found in firearms, such as pistols, rifles, and shotguns, those skilled in the art will recognize that the technology described herein may be similarly applicable to other types of guns as discussed above. As an example, comparable components may be included in vehicle-mounted weapons that are not intended to be held or operated by hand. While not shown in FIG. 1, the gun 100 may also include a striker (e.g., a ratcheting striker or rotating striker) or a hammer that can be actuated in response to pulling the trigger 105. Pulling the trigger 105 may result in the release of the striker or hammer, thereby causing the striker or hammer to contact a firing pin, percussion cap, or primer, so as to ignite a propellant and fire a projectile through the barrel 110. Embodiments of the gun 100 may also include a blowback system, a locked breech system, or any combination thereof. These systems are more commonly found in self-reloading firearms. The blowback system may be responsible for obtaining energy from the motion of the case of the projectile as it is pushed to the rear of the gun 100 by expanding propellant, while the locked breech system may be responsible for slowing down the opening of the breech of a self-reloading firearm when fired. Accordingly, the gun 100 may support the semi-automatic firing of projectiles, the automatic firing of projectiles, or both.

The gun 100 may include one or more safeties that are meant to reduce the likelihood of an accidental discharge or an unauthorized use. The gun 100 may include one or more mechanical safeties, such as a trigger safety or a firing pin safety. The trigger safety may be incorporated in the trigger 105 to prevent the trigger 105 from moving in response to lateral forces placed on the trigger 105 or dropping the gun. The term "lateral forces," as used herein, may refer to a force that is substantially orthogonal to a central axis 145 that extends along the barrel 110 from the front to the rear of the gun 100. The firing pin safety may block the displacement path of the firing pin until the trigger 105 is pulled. Additionally or alternatively, the gun 100 may include one or more electronic safety components, such as an electronically actuated drop safety. In some cases, the gun 100 may include both mechanical and electronic safeties to reduce the potential for an accidental discharge and enhance the overall safety of the gun 100.

The gun 100 may include one or more sensors, such as a user presence sensor 125 and a biometric sensor 140. In some cases, the gun 100 may include multiple user presence sensors 125 whose outputs can collectively be used to detect the presence of a user. For example, the gun 100 may include a time of flight (TOF) sensor, a photoelectric sensor, a capacitive sensor, an inductive sensor, a force sensor, a resistive sensor, or a mechanical switch. As another example, the gun 100 may include a proximity sensor that is configured to emit an electromagnetic field or electromagnetic radiation, like infrared, and looks for changes in the field or return signal. As another example, the gun 100 may include an inertial measurement unit (IMU) configured to identify a presence event in response to measuring movement that matches a movement signature of a user picking up the gun 100. As another example, the gun 100 may include an audio input mechanism (e.g., a transducer implemented in a microphone) that is configured to generate a signal that is representative of nearby sounds, and the presence of the user can be detected based on an analysis of the signal.

The gun 100 may also include one or more biometric sensors 140 as shown in FIG. 1. For example, the gun 100 may include a fingerprint sensor (also referred to as a "fingerprint scanner"), an image sensor, or an audio input mechanism. The fingerprint scanner may generate a digital image (or simply "image") of the fingerprint pattern of the user, and the fingerprint pattern can be examined (e.g., on the gun 100 or elsewhere) to determine whether the user should be verified. The image sensor may generate an image of an anatomical feature (e.g., the face or eye) of the user, and the image can be examined (e.g., on the gun 100 or elsewhere) to determine whether the user should be verified. Normally, the image sensor is a charge-coupled device (CCD) or complementary metal-oxide semiconductor (CMOS) sensor that is included in a camera module (or simply "camera") able to generate color images. The image sensor need not necessarily generate images in color, however. In some embodiments, the image sensor is configured to generate ultraviolet, infrared, or near infrared images. Regardless of its nature, images generated by the image sensor can be used to authenticate the presence or identity of the user. As an example, an image generated by a camera may be used to perform facial recognition of the user. The audio input mechanism may generate a signal that is representative of audio containing the voice of the user, and the signal can be examined (e.g., on the gun 100 or elsewhere) to determine whether the user should be verified. Thus, the signal generated by the audio input mechanism may be used to perform speaker recognition of the user. Including multiple biometric sensors in the gun 100 may support a robust authentication procedure that functions in the event of sensor failure, thereby improving gun reliability. Note, however, that each of the multiple biometric sensors may not provide the same degree or confidence of identity verification. As an example, the output produced by one biometric sensor (e.g., an audio input mechanism) may be used to determine whether a user is present while the output produced by another biometric sensor (e.g., a fingerprint scanner or image sensor) may be used to verify the identity of the user in response to a determination that the user is present.

The gun 100 may include one or more components that facilitate the collection and processing of token data. For example, the gun 100 may include an integrated circuit (also referred to as a "chip") that facilitates wireless communication. The chip may be capable of receiving a digital identifier, such as a Bluetooth® token or a Near Field Communication (NFC) identifier. The term "authentication data" may be used to described data that is used to authenticate a user. For example, the gun 100 may collect authentication data from the user to determine that the user is authorized to operate the gun 100, and the gun 100 may be unlocked in based on determining that the user is authorized to operate the gun 100. Authentication data may include biometric data, token data, or both. Authentication data may be referred to as enrollment data when used to enroll a user, and authentication data may be referred to as query data when used to authenticate a user. In some examples, the gun may transform (e.g., encrypt, hash, transform, encode, etc.) enrollment data and store the transformed enrollment data in memory (e.g., non-volatile memory) of the gun, and the gun may discard or refrain from storing query data in the memory. Thus, the gun 100 may transform authentication data, so as to inhibit unauthenticated use even in the event of unauthorized access of the gun.

The gun 100 may support various types of aiming sights (or simply "sights"). At a high level, a sight is an aiming device that may be used to assist in visually aligning the gun 100 (and, more specifically, its barrel 110) with a target. For example, the gun 100 may include iron sights that improve aim without the use of optics. Additionally or alternatively, the gun 100 may include telescopic sights, reflex sights, or laser sights. In FIG. 1, the gun 100 includes two sights—namely, a front sight 130 and a rear sight 135. In some cases, the front sight 130 or the rear sight 135 may be used to indicate gun state information. For example, the front sight 130 may include a single illuminant that is able to emit light of different colors to indicate different gun states. As another example, the front sight 130 may include multiple illuminants, each of which is able to emit light of a different color, that collectively are able to indicate different gun states. One example of an illuminant is an LED.

The gun 100 may fire projectiles, and the projectiles may be associated with lethal force or less-lethal force. For example, the gun 100 may fire projectiles containing lead, brass, copper, zinc, steel, plastic, rubber, synthetic polymers (e.g., nylon), or a combination thereof. In some examples, the gun 100 is configured to fire lethal bullets containing lead, while in other cases the gun 100 is configured to fire less-lethal bullets containing rubber. As mentioned above, the technology described herein may also be used in the context of a gun that fires prongs (also referred to as "darts") which are intended to contact or puncture the skin of a target and then carry electric current into the body of the target. These guns are commonly referred to as "electronic control weapons" or "electroshock weapons." One example of an electroshock weapon is a TASER device.

The gun 100 may be coupled with an attachment 150, and the attachment 150 may include the front sight 130. As an example, the front sight 130 may be an example of an electronic sight that includes an LED that is coupled with a communication channel terminating at a physical interface, and the physical interface may be configured to be coupled with a corresponding interface of the gun 100. For example, the attachment 150 may include a male USB-C interface and the gun 100 may include a female USB-C interface.

The attachment 150 may include a top surface having a longitudinal axis defined therethrough, the top surface including the front sight 130 that is parallel with the longitudinal axis. The longitudinal axis may be parallel with the lengthwise axis of the barrel 110. The attachment 150 may include a front surface having a latitudinal axis defined therethrough that is perpendicular to the longitudinal axis, the front surface comprising a muzzle aperture with a diameter of at least 5 millimeters. The latitudinal axis may be parallel with a transverse axis of the barrel 110. In other words, the front surface of the attachment 150 may be oriented on the same plane as the muzzle edge of the barrel 110 such that an aperture in the attachment 150 would allow a projectile to be projected through the barrel 110 and through the aperture without contacting the front surface (or any surface) of the attachment 150.

The attachment may include a left surface comprising a first mounting aperture, the left surface extending from the front surface and parallel to the longitudinal axis, a right surface comprising a second mounting aperture that is aligned with the first mounting aperture of the left surface, the right surface extending from the front surface and parallel to the longitudinal axis, and a locking pin capable affixing the attachment 150 to the gun 100. The locking pin may be capable of being positioned inside the first mounting aperture of the left surface and inside the second mounting aperture of the right surface such that the locking pin contacts an interior edge of the first mounting aperture of the left surface and an interior edge of the second mounting aperture of the right surface, wherein fastening the attachment with the gun 100 by placing the locking pin in the first mounting aperture of the left surface and in the second mounting aperture of the right surface results in the longitudinal axis being parallel with a longitudinal axis defined through a bore of the barrel 110 of the gun 100.

Figure 2:
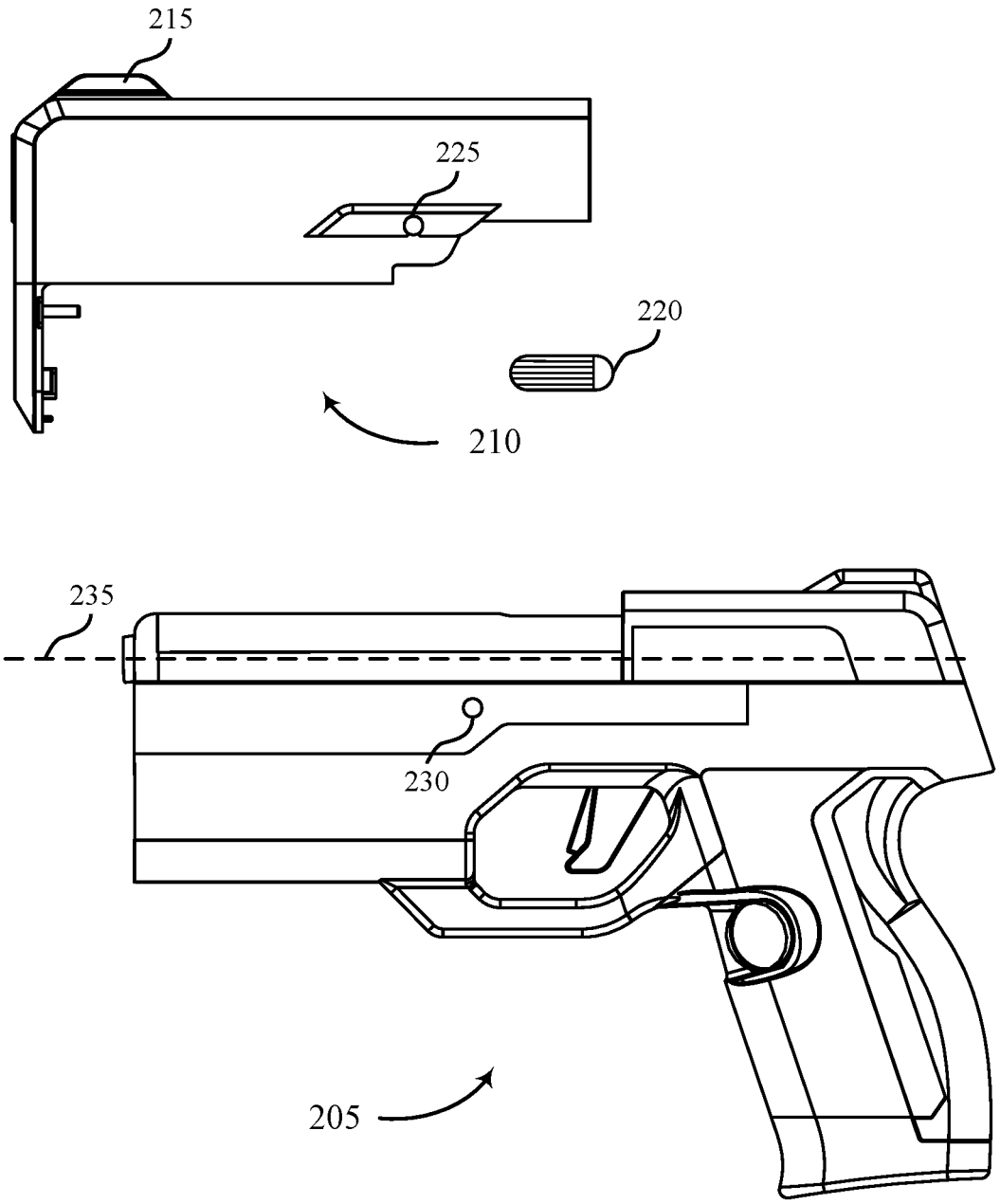
FIG. 2 illustrates an example of a gun and an example of an attachment for the gun.

FIG. 2 illustrates an example of a gun 205 and an example of an attachment 210 for the gun 205. The gun 205 may be an example of the gun 100 as described with reference to FIG. 1.

The attachment 210 includes a sight 215, which may be an example of an iron sight an electronic sight. For example, the sight 215 may include a light pipe that is parallel with the central axis 235 as a result of the attachment 210 being fastened with the gun 205. The attachment 210 may be fastened to the gun 205 by placing a locking pin 220 (e.g., a takedown lever, a friction pin, etc.) in the aperture 225 and the aperture 230. The locking pin 220 may be used to fasten the attachment 210 to the gun 205 by placing the locking pin 220 transversely across the central axis 235. The central axis 235 is an example of a longitudinal axis defined through the bore of the barrel of the gun 205.

The embodiment shown in FIG. 2 the locking pin 220 an example of a fastening mechanism (also called a "locking mechanism" or a "securement mechanism"), but it should be understood that an additional or alternative fastening mechanism may be used to couple an attachment with a gun. For example, an attachment may be coupled with a gun based on a fastening mechanism such as a magnet, an adhesive, or a mechanism feature (e.g., a detent, a notch, a bolt, a rivet, a clasp, etc.).

Figure 3:
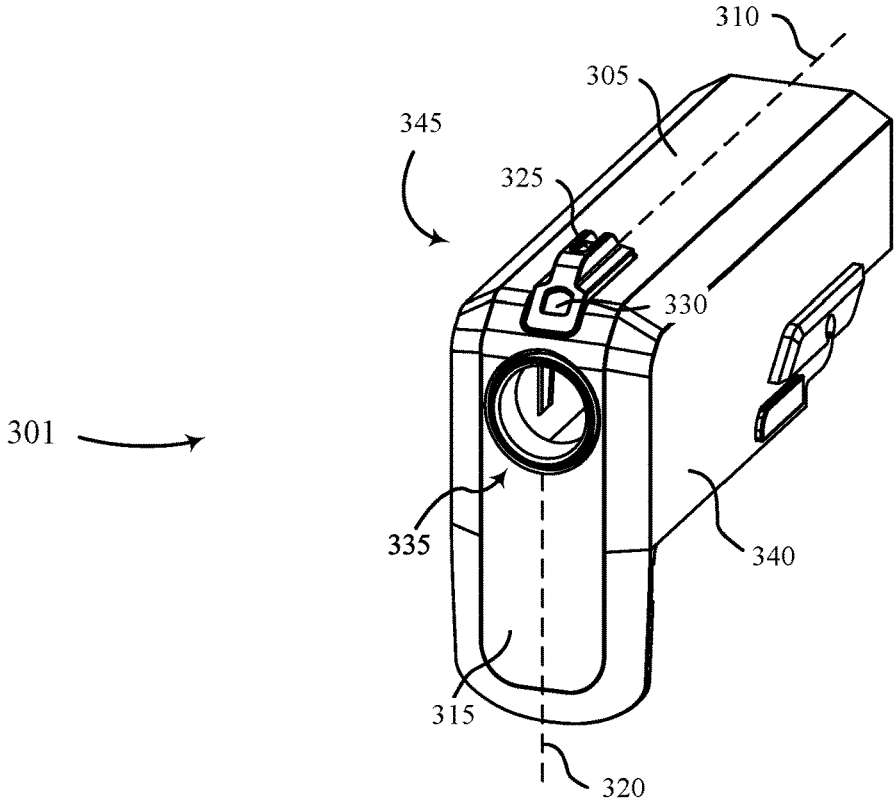
FIG. 3 illustrates examples of attachments that may be coupled with a gun.
Figure 3:
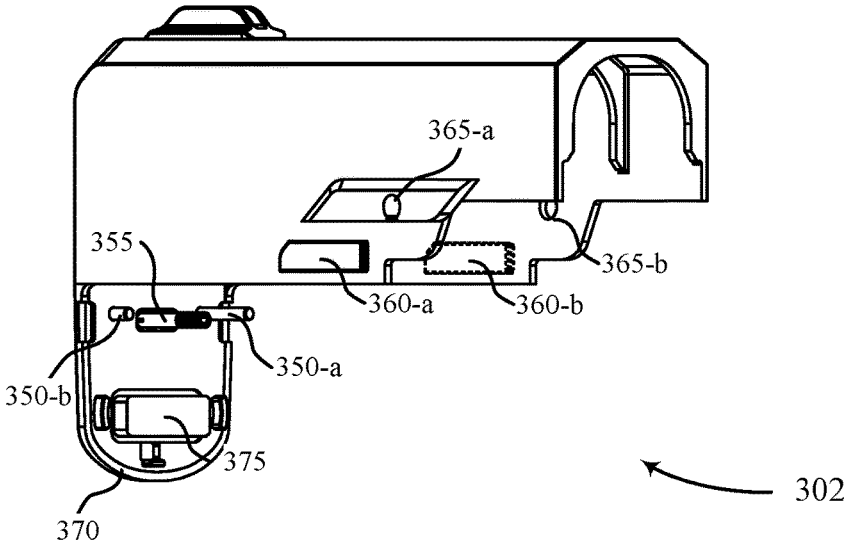

FIG. 3 illustrates an example of an attachment 301 and an example of an attachment 302 that can be coupled with a gun. The attachment 301 provides a front-angled perspective of an attachment and the attachment 302 provides a rear-angled perspective of an attachment.

The attachment 301 includes a top surface 305 with a longitudinal axis 310 and a front surface 315 with a latitudinal axis 320. The latitudinal axis 320 may be perpendicular to the longitudinal axis 310. The longitudinal axis 310 may be parallel with a lengthwise axis of the sight 325, and the longitudinal axis 310 may be configured to be parallel with a lengthwise axis of a bore of a gun barrel when the attachment 301 is fastened to the gun. The latitudinal axis 320 may be parallel with a cross sectional axis of the aperture 335, and the latitudinal axis 320 may be configured to be parallel with a cross sectional axis of a muzzle of the gun barrel when the attachment 301 is fastened to the gun.

The attachment 301 includes a window 330 for an ambient light sensor that may be integrated into the attachment 301. The ambient light sensor may measure light, and the brightness of the sight 325 may be adjusted in response to the light measured by the ambient light sensor. The aperture 335 (e.g., a muzzle aperture or an aperture of the front surface 315) may be designed to be aligned with a muzzle of the gun barrel when the attachment 301 is fastened to the gun. In other words, the aperture 335 may envelope the bore of the barrel of the gun when the attachment 301 is fastened to the gun. The aperture 335 may be considered to envelope the bore of the barrel when the center of the aperture 335 is oriented about the center of the bore or when the aperture 335 is located such that a projectile is capable of being propelling through the bore and out through the aperture 335.

The size of the aperture 335 may be designed based on the type of gun the attachment 301 is intended to be fastened to. In some examples, the diameter of the aperture 335 may be at least as large as a first threshold (e.g., a bottom threshold or a minimum threshold) and smaller than a second threshold (e.g., a top threshold or a maximum threshold). The first threshold may be 4 millimeters (mms), 8 mms, or anywhere in between, and the second threshold may be 9 mms, 19 mms, or anywhere in between. The aperture 335 may in some examples, be rectangular in shape, and the size of the rectangular shaped aperture 335 may be designed to accommodate projectiles with a diameter that is smaller than the second threshold. In some examples, the aperture 335 may be a circular aperture with a diameter that is larger than the caliber of gun the attachment 301 is intended to fastened to, and the diameter of the aperture 335 may be larger than the caliber of the gun by a fixed amount or a proportional amount. As an illustrative example, the attachment 301 may be configured to be fastened to 9 mm pistols, and the aperture 335 may be a circular aperture with a diameter of 9 mm*1.1, 9 mm*1.2, 9 mm*1.3, 9 mm*1.4, 9 mm*1.5, or anywhere in between. As another example, the attachment 301 may be configured to be fastened to .22 long rifle (LR) pistols, and the aperture 335 may be a circular aperture with a diameter of .22 inches+.05 inches, .22 inches+.1 inches, .22 inches+.2 inches, or anywhere in between. In some examples, the size of the aperture 335 may be configured to accommodate the largest caliber bullet the attachment is intended to be used with.

The attachment 301 includes a left side 340 and a right side 345. The left side 340 and/or the right side 345 may include one or more fastening mechanisms. For example, the left side 340 may include a protruding dovetail joint configured to be inserted into a complementary recessed dovetail joint of the gun. The right side 345 may additionally or alternatively include a protruding dovetail joint configured to be inserted into a complementary recessed dovetail joint of the gun. Including one or more dovetail joints in the attachment 301 inhibits splaying of the attachment and facilitates a secure coupling between the attachment 301 and the gun.

The attachment 302 includes a guide rod 350-*a* (e.g., a first guide rod), a guide rod 350-*b* (e.g., a second guide rod), and an electrical interface 355. The attachment 302 may be fastened to a gun based on aligning the guide rod 350-*a* with a first cavity of the gun and aligning the guide rod 350-*b* with a second cavity of the gun. The guide rod 350-*a* and the guide rod 350-*b* are examples of fastening mechanisms that support fastening the attachment 302 to a gun. The electrical interface 355 may mate with a corresponding electrical interface of the gun. In some examples, the electrical interface 355 may mate with the corresponding electrical interface of the gun based on the guide rod 350-*a* and the guide rod 350-*b* guiding the electrical interface 355 into the corresponding electrical interface of the gun. The electrical interface 355 may provide power to a peripheral component mounting mechanism, such as a picatinny rail. As such, the electrical interface 355 may provide power to components integrated into the attachment 302 and/or components that are removably coupled with the attachment 302.

The attachment 302 includes a protruding rail 360-*a* (e.g., a first protruding rail or a protruding rail of the left side of the attachment 302) and a protruding rail 360-*b* (e.g., a second protruding rail or a protruding rail of the right side of the attachment 302). A dovetail joint is an example of a protruding rail, and a dovetail joint may be referred to simply as a "dovetail." The pair of protruding rails (e.g., the protruding rail 360-*a* and the protruding rail 360-*b*) may be inserted into complementary recesses of the gun to fasten the attachment 302 to the gun. In some examples, the pair of protruding rails may actually be a pair of recessed rails, and the attachment 302 may be fasted to the gun based on protruding rails of the gun being inserted into the pair of recessed rails.

The attachment 302 includes an aperture 365-*a* (e.g., a first aperture of the attachment 302 or an aperture of the left side of the attachment 302) and an aperture 365-*b* (e.g., a second aperture of the attachment 302 or an aperture of the right side of the attachment 302). The pair of apertures (e.g., the aperture 365-*a* and the aperture 365-*b*) may be used to fasten the attachment 302 to a gun. For example, a locking pin (e.g., a takedown lever, a ball-and-socket locking pin, a lynchpin, etc.) may be inserted through the aperture 365-*a*, through the gun, and through the aperture 365-*b* to fasten the attachment 302 to the gun. The locking pin may be inserted through the aperture 365-*a*, through an aperture of a left side of a frame of the gun, through an aperture of a right side of the frame of the gun, and through the aperture 365-*b*. The locking pin may be positioned transversally across a bore axis of the gun to fasten the attachment 302 to the gun, and the locking pin may be rotated to lock the attachment 302 to the gun. For example, the locking pin may lock the attachment 302 to the gun based on a flat surface of the locking pin contacting a locking block of the gun. The bore axis is generally described as the axis that runs down the center of the barrel. The locking pin is an example of a fastening mechanism (also referred to as a "locking mechanism") for fastening the attachment 302 to a gun, and the pair of apertures is an example of a fastening mechanism (also referred to as a "locking mechanism") for fastening the attachment 302 to a gun, but it should be understood that other fastening mechanisms may be used to fasten the attachment 302 to the gun. Bolts, screws, anchors, rivets, clamps, buckles, clasps, clips, adhesive, magnets, cotter pins, and linchpins are examples of additional or alternative fastening mechanisms that may be used to fasten the attachment 302 to a gun.

The attachment 302 includes a gasket 370, which may be used to seal a cavity of the gun. For example, the gasket 370 may be an example of a silicon gasket or a rubber gasket, and the gasket 370 may be used to seal a cavity of the gun, such as a battery pack cavity. The gasket 370 may inhibit contaminates from damaging aspects of the gun, such as a battery pack, an electrical interface, an electrical contact, or the like. The attachment 302 includes a compressible material 375, which may be used to retain a battery pack of the gun. For example, the compressible material 375 may include dense foam that presses against a battery pack of the gun to retain the battery pack in the battery pack cavity. The gasket 370 may seal the battery pack cavity to prevent contaminates from entering the battery pack cavity and potentially damaging the battery pack. The compressible material 375 may be coupled with an alloy chassis of the attachment 302.

Figure 4:
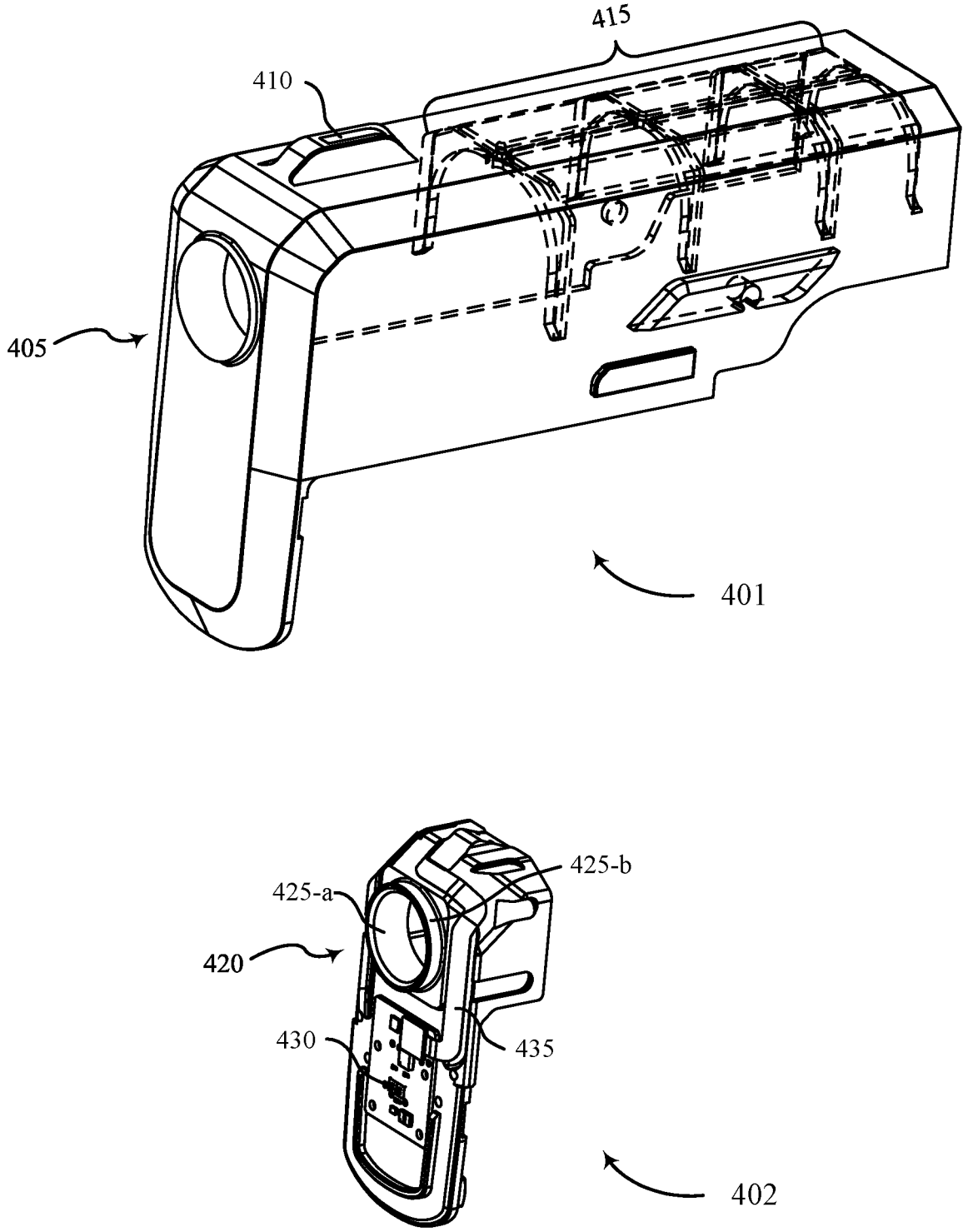
FIG. 4 illustrates an example of an attachment shroud and an example of an attachment chassis.

FIG. 4 illustrates an example of a shroud 401 and an example of a chassis 402, which may be aspects of an attachment described herein. The shroud 401 and the chassis 402 may be coupled together. For example, the chassis 402 may be inserted into a chassis cavity of the shroud 401 such that the shroud 401 and the chassis 402 can be removably coupled to one another. As another example, the chassis 402 may be fused with, or glued to, the shroud 401. As another example, the chassis 402 may molded into the shroud 401 such that the shroud 401 and the chassis 402 are aspects of the attachment. To manufacture an attachment, the chassis 402 may be placed in a mold and a synthetic polymer may be injected into the mold to form the attachment. In other words, the shroud 401 may be injection molded around the chassis 402 to form an attachment for a gun.

The shroud 401 may be joined with or otherwise include the chassis 402 to form an attachment for a gun. The shroud 401 may be constructed of a synthetic polymer, such as a nylon-based polymer. The synthetic polymer may include, for example, polyamide with glass fiber. The glass fiber may form 1-5 percent of the polymer by weight, 1-10 percent of the polymer by weight, 5-10 percent of the polymer by weight, 5-15 percent of the polymer by weight, 10-15 percent of the polymer by weight, 10-20 percent of the polymer by weight, or the like. Including the glass fiber in the polymer can be used to increase the weight and strength of the attachment. The shroud 401 may undergo a procedure to improve the corrosion resistance, such as a ferritic nitrocarburizing procedure. Performing the procedure to improve the corrosion resistance (e.g., a corrosion protection procedure) can improve the durability of the shroud 401.

The shroud 401 can include an aperture 405 (e.g., a muzzle aperture), a sight 410, and an internal structure 415. The aperture 405 may be configured to allow projectiles to pass through, the sight 410 may be configured to assist in aiming the attachment (and the gun the attachment is fastened to), and the internal structure 415 may enhance the strength of the attachment. The internal structure may include multiple arcuate components contacting an interior edge of the left side of the shroud 401, an interior edge of the top side of the shroud 401, and an interior edge of the right side of the shroud 401. The arcuate components may include a synthetic polymer, and the multiple arcuate components may enhance the strength of the shroud 401. The arcuate component may be created through an injection molding procedure.

The chassis 402 may be an aspect of an attachment described herein. For example, the chassis 402 may be joined with or otherwise integrated into the shroud 401 to form an attachment. In some examples, the chassis 402 may be constructed of an alloy material, such as an iron alloy, an aluminum alloy, or a titanium alloy. For example, the chassis 402 may be constructed of steel, manganese steel, nickel steel, chromium steel, vanadium steel, or molybdenum steel. In some other examples, the chassis 402 may be constructed of a synthetic material, such as carbon fiber.

The chassis 402 includes an aperture 420 (e.g., a muzzle aperture), and the aperture 420 includes an interior surface 425-*a* and an exterior surface 425-*b*. The interior surface 425-*a* or the exterior surface 425-*b* may include threads and be referred to as a mounting surface. The aperture 420 of the chassis 402 may be located inside the aperture 405 of the shroud 401. The mounting surface of the chassis 402 may be configured to mount a suppressor, a compensator, a thread protector, or an adapter mechanism.

The chassis 402 includes a circuit board 430 and a communication channel 435. The circuit board 430 may be used to power control peripheral components of the attachment. For example, the communication channel 435 may be electronically coupled with the circuit board 430, a peripheral component of the attachment (e.g., the sight 410, an LED, a laser sight, a flashlight, an ambient light sensor, a button, etc.), an electrical interface of the attachment. A light source is an example of a peripheral component, and examples of a light source include a flashlight, a laser sight, and an LED. The electrical interface may be configured to electronically couple the attachment with a gun, such as an electromechanical gun.

Figure 5:
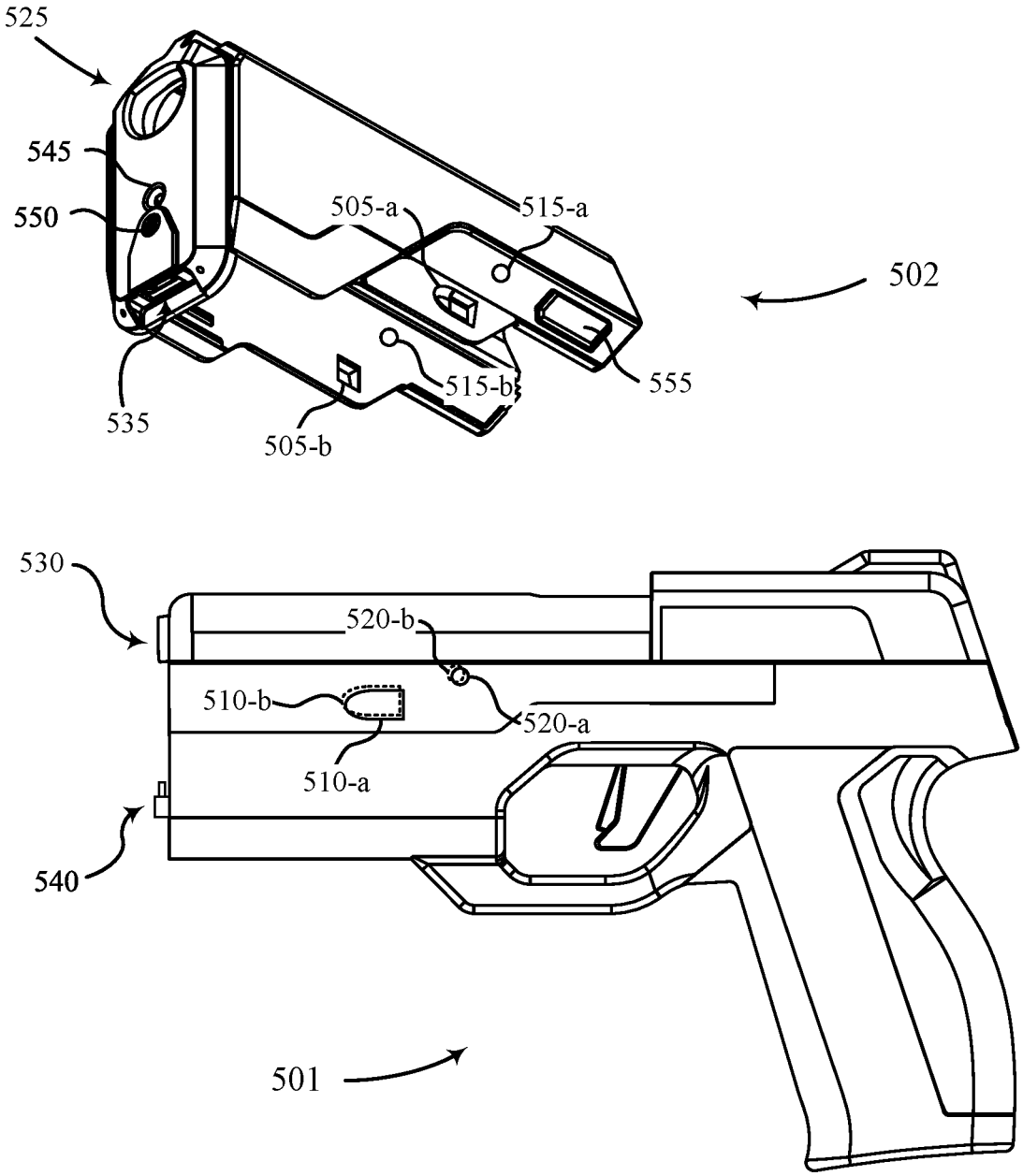
FIG. 5 illustrates an example of a gun and an example of an attachment that can be fastened to the gun.

FIG. 5 illustrates an example of a gun 501 that can be coupled with an attachment 502. The attachment 502 includes a fastening system for fastening the attachment 502 to the gun 501. FIG. 5 illustrates an example of a fastening system that includes multiple fastening mechanisms, but it should be understood that additional or alternative fastening mechanisms may be used to fasten the attachment 502 to the gun 501. For example, the attachment 502 includes a cavity 505-*a* that is configured to snap onto the protrusion 510-*a* and a cavity 505-*b* that is configured to snap onto the protrusion 510-*b*, but the cavity 505-*a* may instead be a protrusion, the cavity 505-*b* may instead be protrusion, the protrusion 510-*a* may instead be a cavity, and the protrusion 510-*b* may instead be a cavity.

The attachment 502 includes an aperture 515-*a* (e.g., a first aperture of the attachment 502 or an aperture of the left side of the attachment 502) and an aperture 515-*b* (e.g., a second aperture of the attachment 502 or an aperture of the right side of the attachment 502). The gun 501 includes an aperture 520-*a* (e.g., a first aperture of the gun 501 or an aperture of the left side of the gun 501) and an aperture 520-*b* (e.g., a second aperture of the gun 501 or an aperture of the right side of the gun 501). The attachment 502 may be fastened to the gun 501 by inserting a locking pin (e.g., a friction pin, a takedown lever, a spring clop, a ball locking pin, etc.) into the aperture 515-*a*, into the aperture 520-*a*, into the aperture 520-*b*, and into the aperture 515-*b*. The locking pin may be positioned transversally across a lengthwise axis of the barrel 530 of the gun 501.

As a result of fastening the attachment 502 to the gun 501, the aperture 525 (e.g., a muzzle aperture) may be centered around the bore of the barrel 530. The aperture 525 may be at least as big as the size of the bore of the barrel 530.

In some examples, the attachment may include an electrical interface 535. For example, the gun 501 may include an electrical interface 540 and the electrical interface 535 may be configured to mate with the electrical interface 540. As an illustrative example, the electrical interface 535 may be a female USB interface and the electrical interface 540 may be a male USB interface. As another illustrative examples, the electrical interface 535 may be a male USB interface and the electrical interface 540 may be a female USB interface. The electrical interface 535 may mate with the electrical interface 540 as a result of fastening the attachment 502 to the gun 501.

The attachment 502 includes a flashlight 545, a laser sight 550, and a button 555 as examples of peripheral components. The peripheral components may be powered by the gun 501. For example, the gun 501 may provide power to the interface 540, the attachment may receive power at the electrical interface 535, and the attachment 502 may use the received power to perform functions at the peripheral components of the attachment 502.

Figure 6:
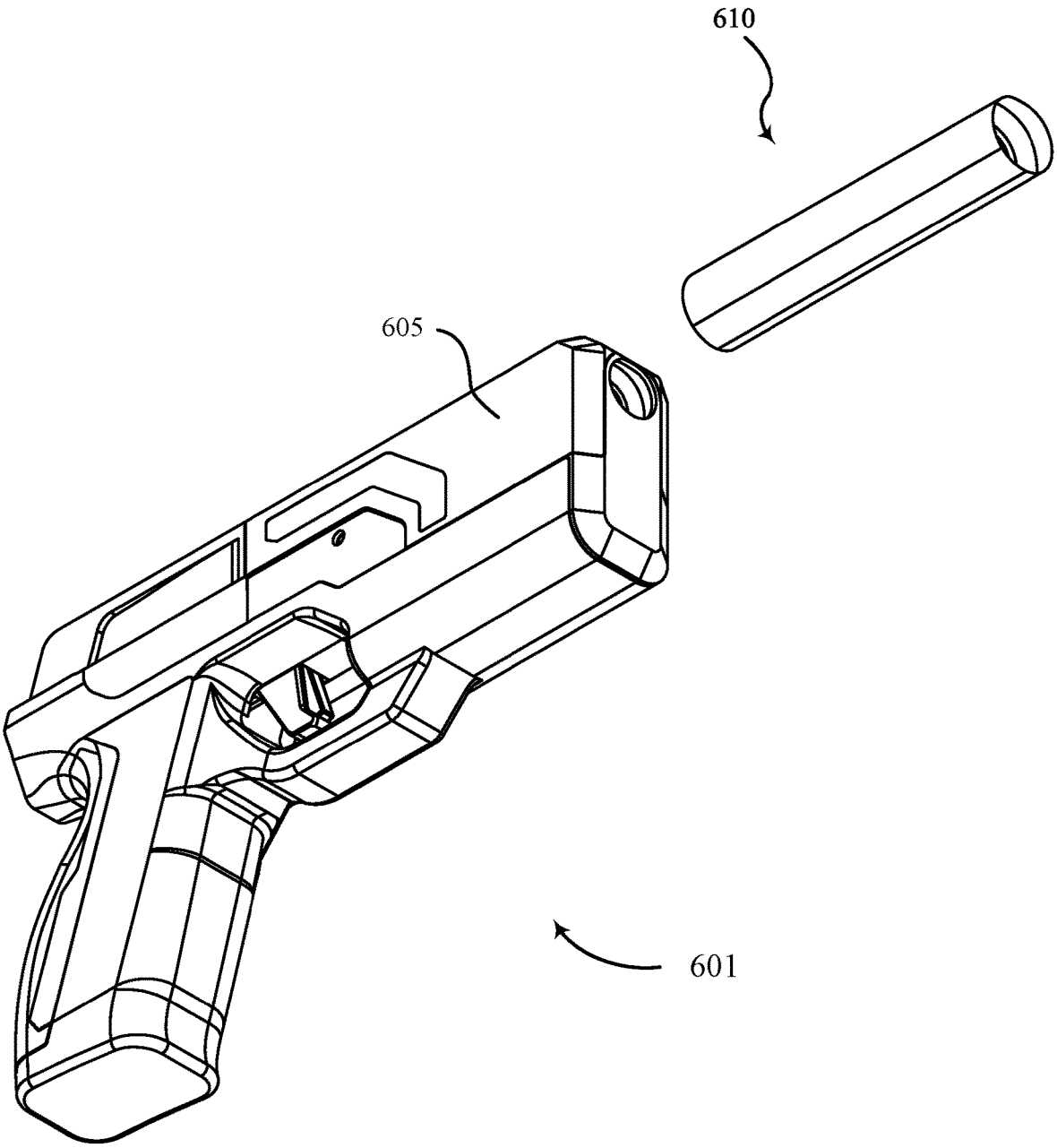
FIG. 6 illustrates an example of a gun with an attachment that can be coupled with a suppressor.

FIG. 6 illustrates an example of a gun 601 with an attachment 605 that can be used as a platform for peripheral components, such as a suppressor 610, a compensator, an adapter mechanism, a thread protector, or the like.

The attachment 605 is described in the context of the suppressor 610, but it should be understood that the suppressor 610 can represent a compensator, an adapter mechanism, a or thread protector. The attachment 605 may include threads that are capable of mating with corresponding threads of the suppressor 610. For example, the attachment 605 may include threads on an exterior mounting surface and the suppressor 610 may include corresponding threads on an interior surface. As another example, the attachment 605 may include threads on an interior surface, such as an interior surface of a muzzle aperture, and the suppressor 610 may include corresponding threads on an exterior surface. As yet another example, the threads on the attachment 605 may be configured to mate with corresponding threads on an adapter mechanism, and the adapter mechanism may be fastened to the threads of the attachment 605, and the threads of the suppressor 610 may be fastened to exposed threads of the adapter mechanism.

Figure 7:
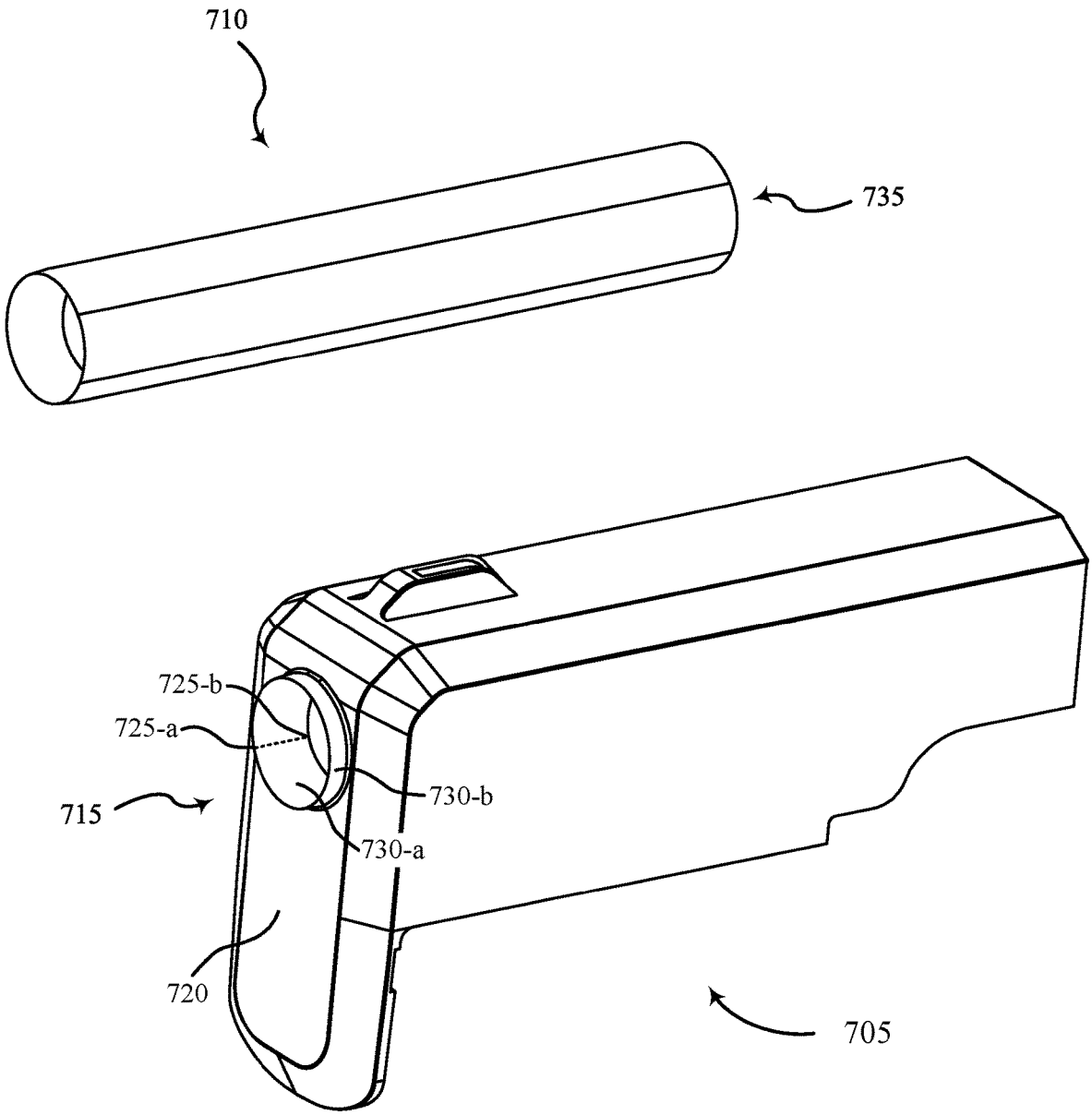
FIG. 7 illustrates an example of an attachment and an example of a suppressor that can be coupled with the attachment.

FIG. 7 illustrates an example of an attachment 705 that can be coupled with a suppressor 710. The attachment 705 is described in the context of the suppressor 710, but it should be understood that the suppressor 710 can represent a compensator, an adapter mechanism, a or thread protector. An adapter mechanism may be fastened to attachment 705, and the suppressor 710 may be fastened to the adapter mechanism. The suppressor 710 may include a threaded end 735 that is configured to mate with complementary threads of the attachment 705 or complementary threads of an adapter mechanism. For example, the attachment 705 may include male threads configured to mate with female threads of the adapter mechanism, and the adapter mechanism may include an adapter attachment mechanism configured to be removably coupled with the suppressor 710.

The muzzle aperture 715 may be an example of a cylindrical aperture with a top end 725-*a* (also referred to as a proximate end) that is located proximate to a front surface 720 and a bottom end 725-*b* (also referred to as a distal end) that is located distally from the front surface 720. The attachment 705 may include an interior mounting surface 730-*a*, an exterior mounting surface 730-*b*, or both. The muzzle aperture 715 may be a tapered cylinder, and the diameter of the muzzle aperture 715 at the bottom end 725-*b* may be smaller than the diameter of the muzzle aperture 715 at the top end 725-*a*. Designing the muzzle aperture 715 as a tapered cylinder promotes the egress of hot gas away from the attachment 705, thereby reducing the impact of hot gas on the attachment 705 and improving the longevity of the attachment 705.

The muzzle aperture 715 may be configured to envelope a barrel of a gun for a distance satisfying a distance threshold, and the distance threshold may be associated with the recoil distance of the barrel of the gun. For example, the barrel of a first gun may have a recoil distance of 2 mm while the barrel of a second gun may have a recoil distance of 5 mm. As such, the depth (or length, or the distance for which the muzzle aperture envelopers the barrel) of the muzzle aperture 715, which can be defined as the distance between the top end 725-*a* and the bottom end 725-*b*, may be at least 2 mm when configured for use with the first gun and at least 5 mm when configured for use with the second gun. In some examples, the top end 725-*a* of the muzzle aperture 715 defines a top-end circumference and the bottom end 725-*b* of the muzzle aperture 715 defines a bottom-end circumstance that is smaller than the top-end circumference.

The interior mounting surface 730-*a* and/or the exterior mounting surface 730-*b* may be as aspect of an attachment chassis or an attachment shroud. For example, the exterior mounting surface 730-*b* may be an aspect of an attachment chassis, and the exterior mounting surface 730-*b* may include threads that are configured to mate with complementary threads of a peripheral component, such as an adapter mechanism, a thread protector, a suppressor, or a compensator.

An adapter mechanism may include threads configured to mate with threads on the interior mounting surface 730-*a* or threads on the exterior mounting surface 730-*b*. The adapter mechanism may include an adapter attachment mechanism configured to be fastened with a suppressor, a compensator, or a thread protector. For example, the adapter attachment mechanism may include a three-lug mounting system for fastening a suppressor to the adapter mechanism. As an additional or alternative example, when fastened to the attachment 705, the adapter mechanism may expose additional threads configured for fastening a suppressor to the adapter mechanism.

Figure 8:
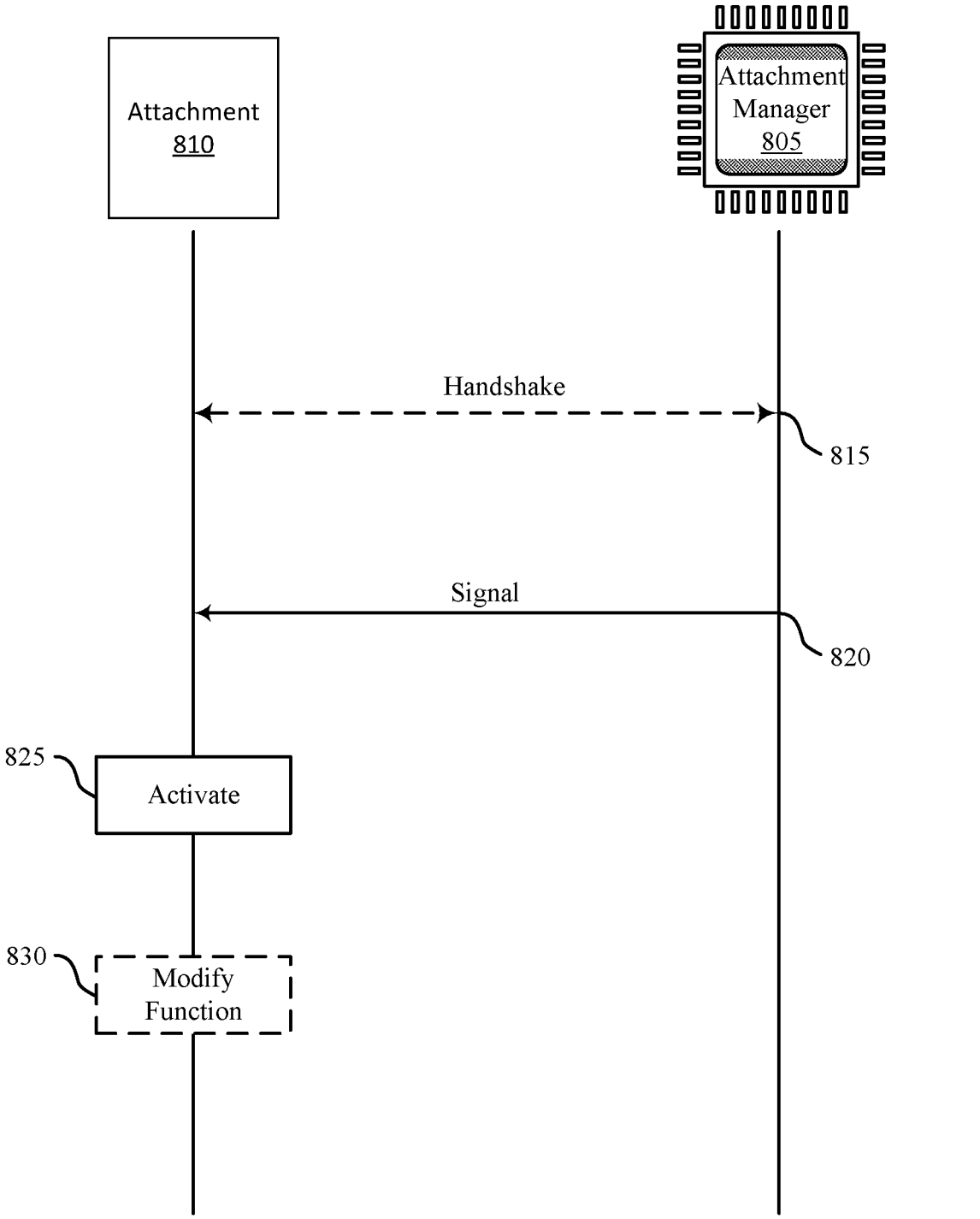
FIG. 8 illustrates an example of a process flow for communicating with a gun.

FIG. 8 illustrates an example of a process flow 800 for communicating with a gun in accordance with aspects of the present disclosure. The process flow 800 involves an attachment manager 805 and an attachment 810, which may be examples of the corresponding components described with reference to FIGS. 1 through 7. The attachment manager 805 may be an example of a processor or a controller. Alternative examples of the following may be implemented, where some steps are performed in a different order than described or are not performed at all. In some cases, steps may include additional features not mentioned below, or further steps may be added.

At step 815, the attachment 810 may perform a handshake procedure with the attachment manager 805. As an example of a handshake procedure, the attachment 810 may transmit a digital signature to the attachment manager 805, and the attachment manager 805 may verify the identity of the attachment 810 by using an encryption key to validate the authenticity of the digital signature. The attachment manager 805 may determine that the attachment 810 is a trusted device based on validating the authenticity of the digital signature.

As an example of a procedure for validating the authenticity of the digital signature, the attachment 810 may transmit a message containing a first data value and a digital signature to the attachment manager 805. The digital signature may be produced by using a private asymmetric cryptographic key to encrypt the data value. The attachment manager 805 may retrieve a public asymmetric cryptographic key from memory (e.g., memory located within a gun) in response to receiving the message and perform a decryption procedure on the digital signature using the public asymmetric cryptographic key to produce a second data value. The attachment manager 805 may determine that the attachment 810 is authentic based on the second data value being the same as the first data value, and the attachment manager 805 may determine that the attachment 810 is inauthentic based on the second data value being different from the first data value. The data manager 805 may store public asymmetric cryptographic keys in memory and use the public asymmetric cryptographic keys to verify digital signatures generated by device containing private asymmetric cryptographic keys that correspond to the public asymmetric cryptographic keys. In some cases, the handshake procedure may include a random challenge, and the attachment manager 805 may determine that the attachment 810 is authentic based on the attachment 810 successfully completing the random challenge.

At step 820, the attachment manager 805 may transmit a signal to the attachment 810. The attachment 810 may receive the signal in response to the handshake procedure. In some examples, the attachment 810 may receive the signal based on the attachment manager 805 determining that the attachment 810 is a trusted device (e.g., the attachment 810 is in possession of a private asymmetric cryptographic key and the attachment manager 805 is in possession of a public asymmetric cryptographic key that is mathematically related). A private encrypt cryptographic key and a public cryptographic key may be considered mathematically related when the public cryptographic key can encrypt plaintext into ciphertext and the private cryptographic key can decrypt the ciphertext into the plaintext, and vice versa.

The signal may be an activation signal, and the attachment 810 may be activated in response to the signal. In some examples, the signal (e.g., a message or data packet) may be transmitted over a physical communication channel (e.g., a BUS) according to a communication protocol, such as an inter-integrated circuit (I2C) protocol, a serial peripheral interface (SPI) protocol, or a universal asynchronous reception and transmission (UART) protocol, while in some other examples, the signal may be transmitted over a wireless communication channel (e.g., a radio frequency spectrum region) according to a communication protocol, such as a Near Field Communication (NFC) protocol, a radio-frequency identification (RFID) protocol, a Bluetooth® protocol, or a Wi-Fi® protocol.

At step 825, the attachment 810 may be activated. For example, a sight including an LED may be illuminated with a predetermined color of light in response to the signal. As another example, a flashlight or laser sight may be powered on in response to the signal. The sight including the LED, the flashlight, and the laser sight are examples of peripheral components of the attachment 810.

At step 830, the attachment 810 may modify the function performed at the peripheral component. As an illustrative example, the attachment 810 may illuminate an LED of a sight according to a brightness level in response to the signal, measure light based on an ambient light sensor of the attachment 810, and modify the brightness of the LED of the sight based on the light measured. For example, if the ambient light sensor measures light satisfying a bright-light threshold, the attachment may increase the brightness of the sight, and if the ambient light sensor measures light satisfying a low-light threshold, the attachment may decrease the brightness of the sight. In some examples, the attachment 810 may determine a brightness based on a function that receives an indication of the amount of light measured as input and generates a brightness value as output, and the attachment 810 may modify the brightness of the sight to reflect the brightness value. An example of a low-light threshold is .05 lux (lx), .1 lx, .25 lx, .5 lx, 1 lx, 2 lx, 3 lx, or anywhere in between. An example of a bright-light threshold is 200 lx, 500 lx, 1000 lx, 10,000 lx, 50,000 lx, 100,000 lx, or anywhere in between. The low-light threshold may be satisfied based on the ambient light sensor measuring an amount of light that is lower than the low-light threshold, and the bright-light threshold may be satisfied based on the ambient light sensor measuring an amount of light that is higher than the bright-light threshold.

Figure 9:
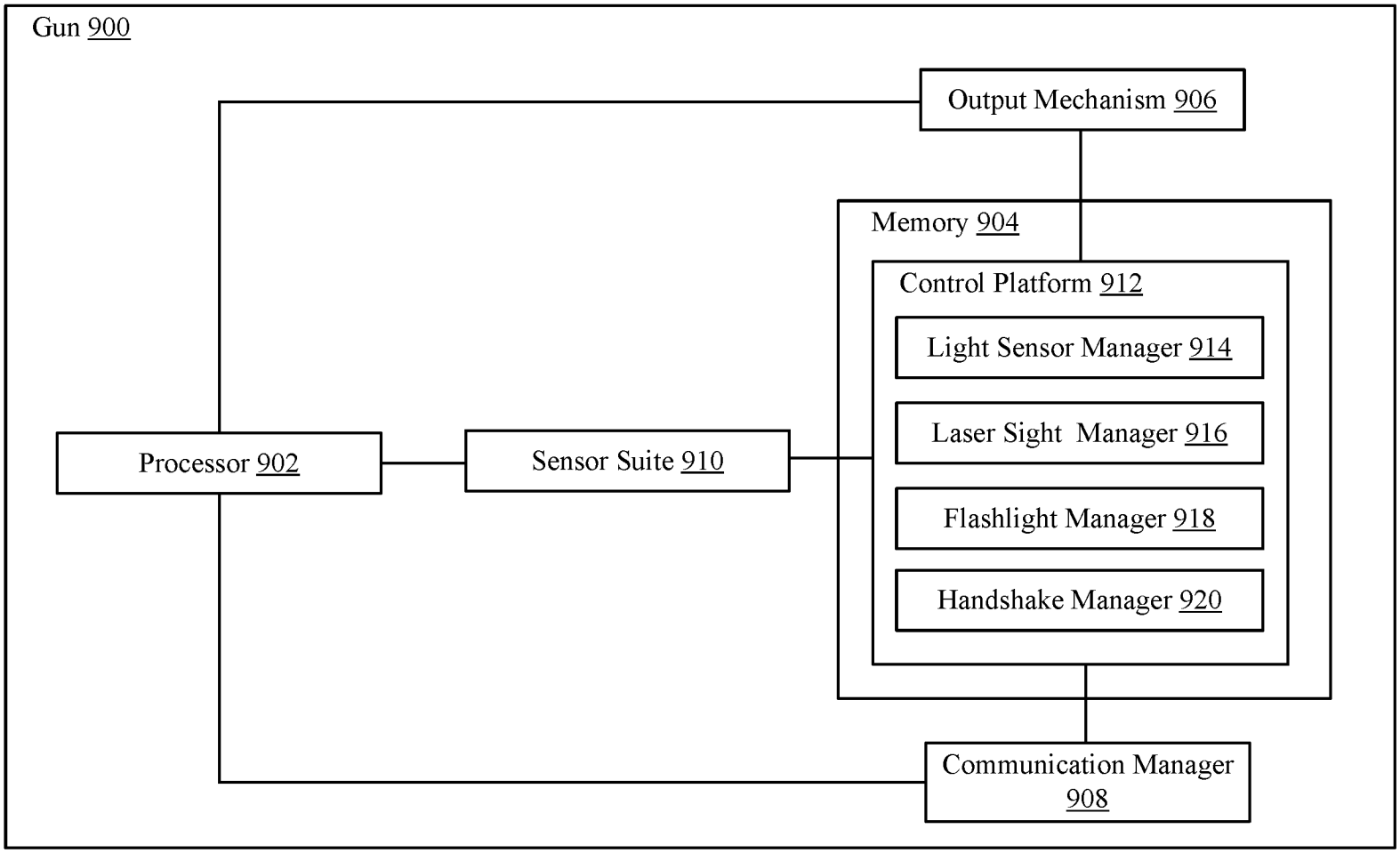
FIG. 9 illustrates an example of a gun that is capable of communicating with an attachment.

FIG. 9 illustrates an example of a gun 900 able to implement a control platform 912 designed to produce outputs that are helpful in ensuring the gun 900 is able to communicate with an attachment. As further discussed below, the control platform 912 (also referred to as a "management platform" or an "attachment manager" may be designed to manage aspects of an attachment, such as peripheral component that are fastened to, or integrated into, the attachment.

In some embodiments, the control platform 912 is embodied as a computer program that is executed by the gun 900. In other embodiments, the control platform 912 is embodied as an electrical circuit that performs logical operations of the gun 900. In yet other embodiments, the control platform 912 is embodied as a computer program that is executed by a computing device to which the gun 900 is communicatively connected. In such embodiments, the gun 900 may transmit relevant information to the computing device for processing as further discussed below. Those skilled in the art will recognize that aspects of the computer program could also be distributed amongst the gun 900 and computing device.

The gun 900 can include a processor 902, memory 904, output mechanism 906, and communication manager 908. The processor 902 can have generic characteristics similar to general-purpose processors, or the processor 902 may be an application-specific integrated circuit (ASIC) that provides control functions to the gun 900. As shown in FIG. 9, the processor 902 can be coupled with all components of the gun 900, either directly or indirectly, for communication purposes.

The memory 904 may be comprised of any suitable type of storage medium, such as static random-access memory (SRAM), dynamic random-access memory (DRAM), electrically erasable programmable read-only memory (EEPROM), flash memory, or registers. In addition to storing instructions that can be executed by the processor 902, the memory 904 can also store data generated by the processor 902 (e.g., when executing the managers of the control platform 912). Note that the memory 904 is merely an abstract representation of a storage environment. The memory 904 could be comprised of actual memory chips or managers.

The output mechanism 906 can be any component that is capable of conveying information to a user of the gun 900. For example, the output mechanism 906 may be a display panel (or simply "display") that includes LEDs, organic LEDs, liquid crystal elements, or electrophoretic elements. Alternatively, the display may simply be a series of illuminants (e.g., LEDs) that are able to indicate the status of the gun 900. Thus, the display may indicate whether the gun 900 is presently in a locked state, unlocked state, etc. As another example, the output mechanism 906 may be a loudspeaker (or simply "speaker") that is able to audibly convey information to the user.

The communication manager 908 may be responsible for managing communications between the components of the gun 900. Additionally or alternatively, the communication manager 908 may be responsible for managing communications with computing devices that are external to the gun 900. Examples of computing devices include mobile phones, tablet computers, wearable electronic devices (e.g., fitness trackers), and network-accessible server systems comprised of computer servers. Accordingly, the communication manager 908 may be wireless communication circuitry that is able to establish communication channels with computing devices. Examples of wireless communication circuitry include integrated circuits (also referred to as "chips") configured for Bluetooth, Wi-Fi, NeNFC, and the like.

Sensors are normally implemented in the gun 900. Collectively, these sensors may be referred to as the "sensor suite" 910 of the gun 900. For example, the gun 900 may include a motion sensor whose output is indicative of motion of the gun 900 as a whole. Examples of motion sensors include multi-axis accelerometers and gyroscopes. As another example, the gun 900 may include a proximity sensor whose output is indicative of proximity of the gun 900 to a nearest obstruction within the field of view of the proximity sensor. A proximity sensor may include, for example, an emitter that is able to emit infrared (IR) light and a detector that is able to detect reflected IR light that is returned toward the proximity sensor. These types of proximity sensors are sometimes called laser imaging, detection, and ranging (LiDAR) scanners. As another example, the gun 900 may include a fingerprint sensor or camera that generates images which can be used for, for example, biometric authentication. As shown in FIG. 9, outputs produced by the sensor suite 910 may be provided to the control platform 912 for examination or analysis.

For convenience, the control platform 912 may be referred to as a computer program that resides in the memory 904. However, the control platform 912 could be comprised of software, firmware, or hardware components that are implemented in, or accessible to, the gun 900. In accordance with embodiments described herein, the control platform 912 may include a light sensor manager 914, a laser sight manager 916, a flashlight manager 918, and a handshake manager 920. As an illustrative example, the light sensor manager 914 may process data generated by an ambient light sensor, the laser sight manager 916 may control or communicate with a laser sight, the flashlight manager 918 may control or communicate with a flashlight, and the handshake manager 920 may transmit and receive data across an electrical interface. Because the data obtained by these managers may have different formats, structures, and content, the instructions executed by these managers can (and often will) be different. For example, the instructions executed by the light sensor manager 914 to process data generated by an ambient light sensor may be different from the instructions generated by the handshake manager 920 to perform a handshake procedure across an electrical interface. As a specific example, the handshake manager 920 may implement error correcting codes that are not necessary for controlling an ambient light sensor.

Figure 10:
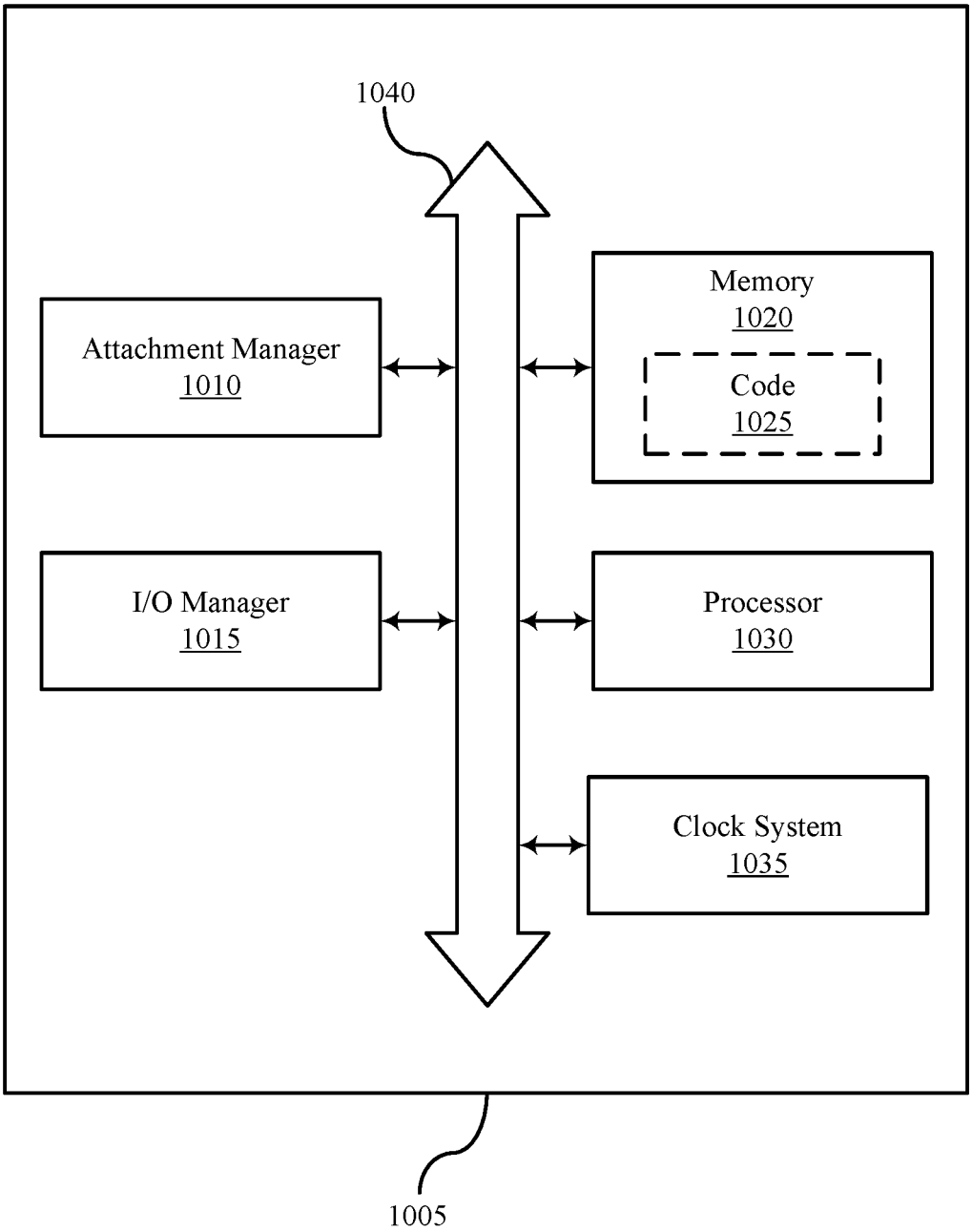
FIG. 10 illustrates an example of a system that supports communication between an attachment and a gun.

FIG. 10 illustrates an example of a system 1000 that supports attachments in accordance with aspects of the present disclosure. The device 1005 may be operable to implement the techniques, technology, or systems disclosed herein. The device 1005 may include components such as an attachment manager 1010, an input/output (I/O) manager 1015, memory 1020, code 1025, a processor 1030, a clock system 1035, and a bus 1040. The components of the device 1005 may communicate via one or more buses 1040. The device 1005 may be an example of, or include components of, a gun or an attachment for a gun.

The attachment manager 1010 may receive a first signal over a communication channel and activate a peripheral component, such as a sight including a light pipe, a laser sight, or a flashlight. In some cases, the attachment manager 1010 may perform a handshake procedure over the communication channel, and the attachment manager 1010 may activate the peripheral component based on the handshake procedure. For example, the attachment manager may determine that the device 1005 is electronically coupled with a trusted device based on the handshake procedure, and the attachment manager may activate the peripheral components based on determining that the device 1005 is electronically coupled with a trusted device.

The device 1005 may include an attachment system, and the attachment system may include one or more attachment mechanisms, such as a fastening aperture, a dovetail joint, a guide rail, a locking pin, or the like.

The I/O manager 1015 may manage input and output signals for the device 1005. The I/O manager 1015 may also manage various peripherals such an input device (e.g., a button, a switch, a touch screen, a dock, a biometric sensor, a pressure sensor, a heat sensor, a proximity sensor, an RFID sensor, etc.) and an output device (e.g., a monitor, a display, an LED, a speaker, a haptic motor, a heat pipe, etc.).

The memory 1020 may include or store code (e.g., software) 1025. The memory 1020 may include volatile memory, such as random-access memory (RAM) and/or non-volatile memory, such as read-only memory (ROM). The code 1025 may be computer-readable and computer-executable, and when executed, the code 1025 may cause the processor 1030 to perform various operations or functions described here.

The processor 1030 may be an example or component of a central processing unit (CPU), an application specific integrated circuit (ASIC), or a field programmable gate array (FPGA). In some embodiments, the processor 1030 may utilize an operating system or software such as Microsoft Windows®, iOS®, Android®, Linux®, Unix®, or the like. The clock system 1035 control a timer for use by the disclosed embodiments.

The attachment manager 1010, or its sub-components, may be implemented in hardware, software (e.g., software or firmware) executed by a processor, or a combination thereof. The attachment manager 1010, or its sub-components, may be physically located in various positions. For example, in some cases, the attachment manager 1010, or its sub-components may be distributed such that portions of functions are implemented at different physical locations by one or more physical components.

Figure 11:
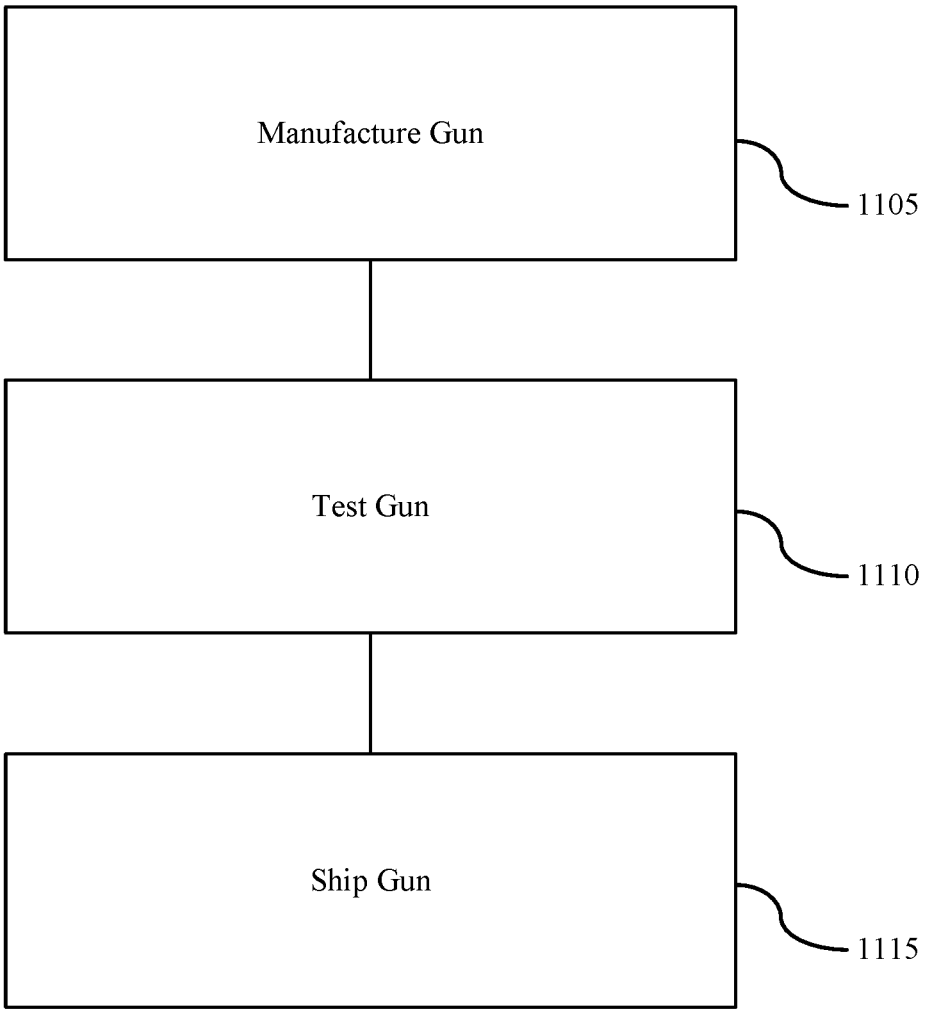
FIG. 11 illustrates an example of a flowchart showing a method of manufacturing a gun attachment.

FIG. 11 illustrates an example of a flowchart showing a method 1100 of manufacturing a gun attachment in accordance with aspects of the present disclosure. Note that while the sequences of the steps performed in the processes described herein are exemplary, the steps can be performed in various sequences and combinations. For example, steps could be added to, or removed from, these processes. Similarly, steps could be replaced or reordered. Thus, the descriptions of these processes are intended to be open ended.

Initially, a gun manufacturer (or simply "manufacturer") may manufacture a gun that is able to implement aspects of the present disclosure (step 1105). For example, the manufacturer may machine, cut, shape, or otherwise make parts to be included in the gun. Thus, the manufacturer may also design those parts before machining occurs, or the manufacturer may verify designs produced by another entity before machining occurs. Additionally or alternatively, the manufacturer may obtain parts that are manufactured by one or more other entities. Thus, the manufacturer may manufacture the gun from components produced entirely by the manufacturer, components produced by other entities, or a combination thereof. Often, the manufacturer will obtain some parts and make other parts that are assembled together to form the gun (or a component of the gun).

The manufacturer or another entity may generate, store, deploy, or otherwise manage cryptographic data associated with a gun. For example, the manufacturer may deploy a cryptographic secret (e.g., a cryptographic key for symmetric cryptographic procedures) into a memory component of the gun to support encryption and decryption at the gun, the manufacturer may deploy a public key into the memory component of the gun to support verifying cryptographic signatures, or the manufacturer may deploy a digital certificate into the memory component of the gun to demonstrate that the signature was created based on the private key associated with the public key, thereby suggesting the authenticity of the public key. One or more cryptographic keys may be used as part of a handshake procedure, such as a handshake procedure to identify a trusted device.

The manufacturer may develop an attachment. In some examples, the attachment may be fastened to a gun. The manufacturer may also develop instructions that support performing functions at the attachment. For example, the manufacturer may produce software and/or firmware that supports measuring ambient light and modifying the brightness of an electronic sight of the attachment based on the amount of ambient light measured.

In some embodiments, the manufacturer also generates identifying information related to the gun. For example, the manufacturer may etch (e.g., mechanically or chemically), engrave, or otherwise append identifying information onto the gun itself. As another example, the manufacturer may encode at least some identifying information into a data structure that is associated with the gun. For instance, the manufacturer may etch a serial number onto the gun, and the manufacturer may also populate the serial number (and other identifying information) into a data structure for recording or tracking purposes. Examples of identifying information include the make of the gun, the model of the gun, the serial number, the type of projectiles used by the gun, the caliber of those projectiles, the type of firearm, the barrel length, and the like. In some cases, the manufacturer may record a limited amount of identifying information (e.g., only the make, model, and serial number), while in other cases the manufacturer may record a larger amount of identifying information.

The manufacturer may then test the gun (step 1110). In some embodiments, the manufacturer tests all of the guns that are manufactured. In other embodiments, the manufacturer tests a subset of the guns that are manufactured. For example, the manufacturer may randomly or semi-randomly select guns for testing, or the manufacturer may select guns for testing in accordance with a predefined pattern (e.g., one test per 5 guns, 10 guns, or 100 guns). Moreover, the manufacturer may test the gun in its entirety, or the manufacturer may test a subset of its components. For example, the manufacturer may test the component(s) that it manufactures. As another example, the manufacturer may test newly designed components or randomly selected components. Thus, the manufacturer could test select component(s) of the gun, or the manufacturer could test the gun as a whole. For example, the manufacturer may test the barrel to verify that it meets a precision threshold and the cartridge feed system to verify that it meets a reliability threshold. As another example, the manufacturer may test a group of guns (e.g., all guns manufactured during an interval of time, guns selected at random over an interval of time, etc.) to ensure that those guns fire at a sufficiently high pressure (e.g., 70,000 pounds per square inch (PSI)) to verify that a safety threshold is met.

Thereafter, the manufacturer may ship the gun to a dealer (step 1115). In the event that the gun is a firearm, the manufacturer may ship the gun to a Federal Firearms Licensed (FFL) dealer. For example, a purchaser (also referred to as a "customer") may purchase the apparatus through a digital channel or non-digital channel. Examples of digital channels include web browsers, mobile applications, and desktop applications, while examples of non-digital channels include ordering via the telephone and ordering via a physical storefront. In such a scenario, the gun may be shipped to the FFL dealer so that the purchaser can obtain the gun from the FFL dealer. The FFL dealer may be directly or indirectly associated with the manufacturer of the gun. For example, the FFL dealer may be a representative of the manufacturer, or the FFL dealer may sell and distribute guns on behalf of the manufacturer (and possibly other manufacturers).

Note that while the sequences of the steps performed in the processes described herein are exemplary, the steps can be performed in various sequences and combinations. For example, steps could be added to, or removed from, these processes. Similarly, steps could be replaced or reordered. As an example, the manufacturer may iteratively test components while manufacturing the gun, and therefore perform multiple iterations of steps 1105 and 1110 either sequentially or simultaneously (e.g., one component may be tested while another component is added to the gun). Thus, the descriptions of these processes are intended to be open ended.

Figure 12:
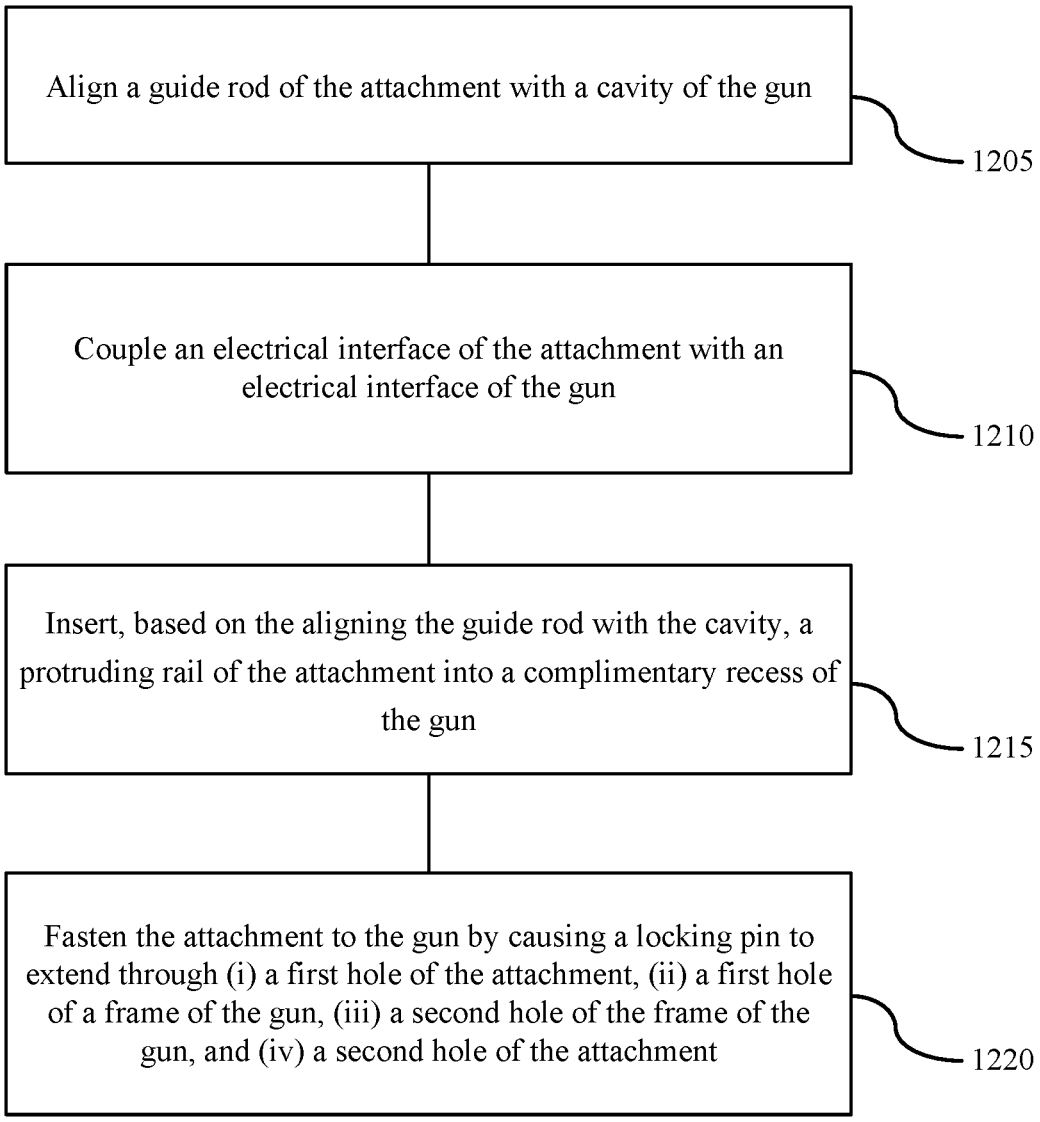
FIG. 12 illustrates an example of a flowchart showing a method of coupling an attachment with a gun.

FIG. 12 illustrates an example of a flowchart showing a method 1200 of coupling an attachment with a gun in accordance with aspects of the present disclosure. The operations of the method 1200 may be implemented by an assembly machine, a manufacturer, or a consumer. For example, the operations of the method 1200 may be performed on an assembly line producing guns. In some examples, an assembly machine may execute a set of instructions to control the functional elements of the assembly machine to perform the described functions.

At step 1205, a guide rod of the attachment may be aligned with a cavity of the gun. In some examples, one guide rod of the attachment may be aligned with one cavity of the gun, and in other examples, the attachment may include multiple guide rods and each guide rod of the multiple guide rods may be aligned with a cavity of the gun.

At step 1210, an electrical interface of the attachment may be coupled with an electrical interface of the gun. The electrical interface of the attachment may be coupled with an electrical interface of the gun based on aligning the guide rod with the cavity.

At step 1215, a protruding rail of the attachment may be inserted into a complimentary recess of the gun. The protruding rail of the attachment may be inserted into the complementary recess of the gun based on aligning the guide rod with the cavity. The protruding rail may be an example of a dovetail joint.

At step 1220, the attachment may be fastened to the gun by causing a locking pin to extend through (i) a first hole of the attachment, (ii) a first hole of a frame of the gun, (iii) a second hole of the frame of the gun, and (iv) a second hole of the attachment. In some examples, the locking pin may be an example of a takedown lever that is positioned transversally across a longitudinal bore axis to fasten the attachment to the gun.

Note that while the sequences of the steps performed in the processes described herein are exemplary, the steps can be performed in various sequences and combinations. For example, steps could be added to, or removed from, these processes. Similarly, steps could be replaced or reordered. Thus, the descriptions of these processes are intended to be open ended.

Figure 13:
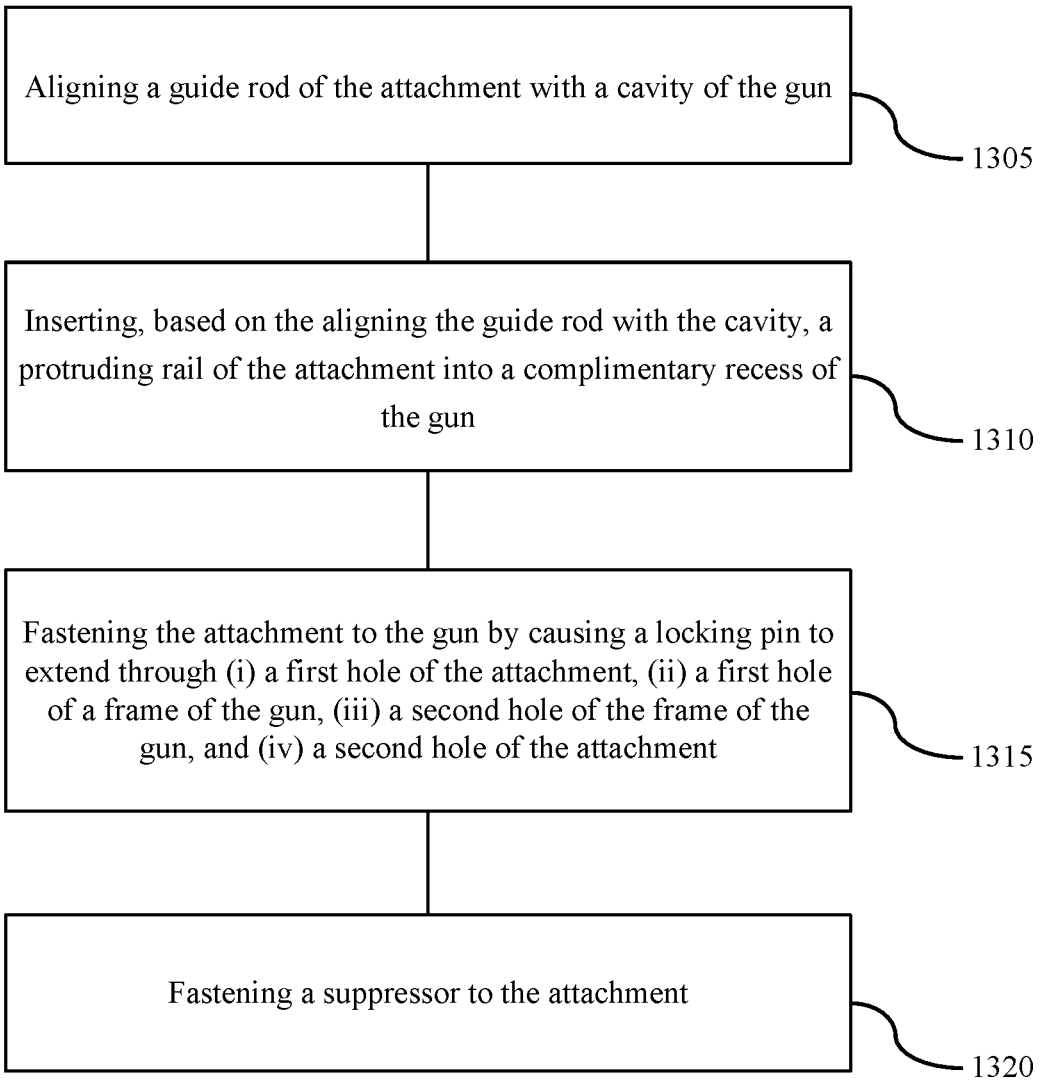
FIG. 13 illustrates an example of a flowchart showing a method of coupling an attachment with a gun.

FIG. 13 illustrates an example of a flowchart showing a method 1300 of coupling an attachment and a gun in accordance with aspects of the present disclosure. The operations of the method 1300 may be implemented by an assembly machine, a manufacturer, or a consumer. For example, the operations of the method 1300 may be performed on an assembly line producing guns. In some examples, an assembly machine may execute a set of instructions to control the functional elements of the assembly machine to perform the described functions.

At step 1305, a guide rod of the attachment may be aligned with a cavity of the gun. In some examples, one guide rod of the attachment may be aligned with one cavity of the gun, and in other examples, the attachment may include multiple guide rods and each guide rod of the multiple guide rods may be aligned with a cavity of the gun.

At step 1310, a protruding rail of the attachment may be inserted into a complimentary recess of the gun. The protruding rail of the attachment may be inserted into the complementary recess of the gun based on aligning the guide rod with the cavity. The protruding rail may be an example of a dovetail joint.

At step 1315, the attachment may be fastened to the gun by causing a locking pin to extend through (i) a first hole of the attachment, (ii) a first hole of a frame of the gun, (iii) a second hole of the frame of the gun, and (iv) a second hole of the attachment. In some examples, the locking pin may be an example of a takedown lever that is positioned transversally across a longitudinal bore axis to fasten the attachment to the gun.

At step 1320, a suppressor may be fastened to the attachment. The suppressor may be fastened to the attachment by rotating the suppressor such that female threads of the suppressor mate with male threads of the attachment. In some examples, an adapter mechanism may be fastened to the attachment, and the suppressor may be fastened to an adapter attachment mechanism of the adapter mechanism.

Note that while the sequences of the steps performed in the processes described herein are exemplary, the steps can be performed in various sequences and combinations. For example, steps could be added to, or removed from, these processes. Similarly, steps could be replaced or reordered. Thus, the descriptions of these processes are intended to be open ended.

Figure 14:
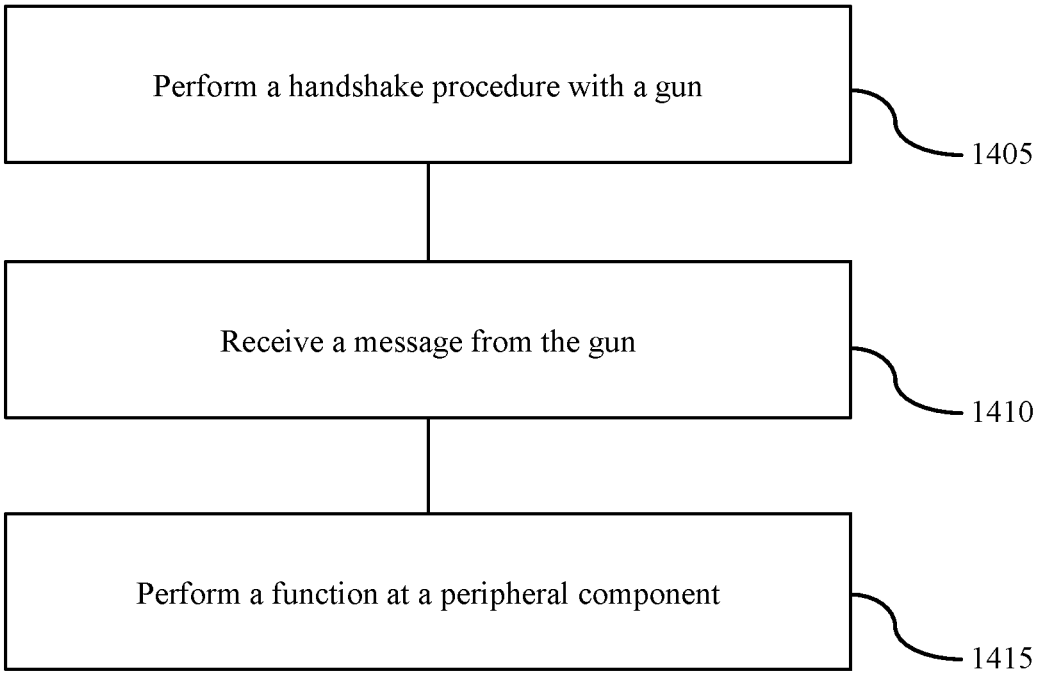
FIG. 14 illustrates an example of a flowchart showing a method of communicating with a gun.

FIG. 14 illustrates an example of a flowchart showing a method 1400 of communicating with a gun in accordance with aspects of the present disclosure. The operations of the method 1400 may be implemented by a gun attachment (or simply "attachment") or components thereof. For example, the operations of the method 1400 may be performed by an attachment manager, processor, a controller, or the like. In some examples, a gun may execute a set of instructions to control the functional elements of the to perform the described functions.

At step 1405, the attachment may perform a handshake procedure with a gun. A physical electrical interface of the attachment may be mated with a physical electrical interface of the gun, and the attachment may receive and/or transmit messages as part of the handshake procedure. The handshake procedure may include identity verification, private cryptographic key possession proof, or cryptographic key agreement. The attachment and the gun may communicate based on an ephemeral cryptographic key agreed upon during the handshake procedure. In some examples, the message received at step 1410 may be an encrypted message that was encrypted using the cryptographic key agreed upon during the handshake procedure.

At step 1410, the attachment may receive a message. In some examples, the message may be received based on the handshake procedure.

At step 1415, the attachment may perform a function at a peripheral component. In some examples, the attachment may perform the function at the peripheral component based on the message. For example, the attachment may illuminate a sight with a color of light based on the message indicating that the sight is to be illuminated with the color.

Note that while the sequences of the steps performed in the processes described herein are exemplary, the steps can be performed in various sequences and combinations. For example, steps could be added to, or removed from, these processes. Similarly, steps could be replaced or reordered. Thus, the descriptions of these processes are intended to be open ended.

EXAMPLES

Several aspects of the present disclosure are set forth examples. Note that, unless otherwise specified, all of these examples can be combined with one another. Accordingly, while a feature may be described in the context of a given example, the feature may be similarly applicable to other examples.

In some examples, the techniques described herein relate to an attachment for a gun, the attachment including: a top surface having a longitudinal axis defined therethrough, the top surface including an aiming sight, the aiming sight including a light-emitting diode and a light pipe that is parallel with the longitudinal axis; a front surface having a latitudinal axis defined therethrough that is perpendicular to the longitudinal axis, the front surface including a muzzle aperture with a diameter of at least 5 millimeters, a guide rod that is parallel with the longitudinal axis, and an electrical interface that is electronically coupled with the light-emitting diode; a left surface including a first mounting aperture, the left surface extending from the front surface and parallel to the longitudinal axis; a right surface including a second mounting aperture that is aligned with the first mounting aperture of the left surface, the right surface extending from the front surface and parallel to the longitudinal axis; and a locking pin capable of being positioned in the first mounting aperture of the left surface and in the second mounting aperture of the right surface such that the locking pin contacts an interior edge of the first mounting aperture of the left surface and an interior edge of the second mounting aperture of the right surface, wherein fastening the attachment with the gun by placing the locking pin in the first mounting aperture of the left surface, in a first mounting aperture of the gun, in a second mounting aperture of the gun, and in the second mounting aperture of the right surface results in the longitudinal axis being parallel with a longitudinal bore axis of the gun.

In some examples, the techniques described herein relate to an attachment for a gun, the attachment including: a top surface having a longitudinal axis defined therethrough, the top surface including an aiming sight that is parallel with the longitudinal axis; a front surface having a latitudinal axis defined therethrough that is perpendicular to the longitudinal axis, the front surface including a muzzle aperture with a diameter of at least 5 millimeters; a left surface including a first mounting aperture, the left surface extending from the front surface; a right surface including a second mounting aperture that is aligned with the first mounting aperture of the left surface, the right surface extending from the front surface; and a locking pin capable of being positioned in the first mounting aperture of the left surface and in the second mounting aperture of the right surface such that the locking pin contacts an interior edge of the first mounting aperture of the left surface and an interior edge of the second mounting aperture of the right surface, wherein fastening the attachment with the gun by placing the locking pin in the first mounting aperture of the left surface and in the second mounting aperture of the right surface results in the longitudinal axis being parallel with a longitudinal bore axis of the gun.

In some examples, the techniques described herein relate to an attachment, further including: an electrical interface configured to be coupled with a complementary electrical interface of the gun based on the fastening the attachment with the gun.

In some examples, the techniques described herein relate to an attachment, further including: a button that is electronically coupled with the electrical interface via a communication channel.

In some examples, the techniques described herein relate to an attachment, further including: a processor that is electronically coupled with the button, wherein the processor is configured to toggle a power status of an electrical component of the attachment in response to the button being pressed.

In some examples, the techniques described herein relate to an attachment, further including: a light-emitting diode that is electronically coupled with the electrical interface via a communication channel; and a light pipe that is electronically coupled with the light-emitting diode.

In some examples, the techniques described herein relate to an attachment, further including: a laser that is electronically coupled with the electrical interface via a communication channel.

In some examples, the techniques described herein relate to an attachment, further including: a flashlight that is electronically coupled with the electrical interface via a communication channel.

In some examples, the techniques described herein relate to an attachment, further including: an ambient light sensor that is capable of measuring light and generating an output indicating an amount of light measured.

In some examples, the techniques described herein relate to an attachment, wherein the aiming sight includes a light-emitting diode that is configured to emit more light in response to the amount of light measured satisfying a high-light threshold, and wherein the light emitting diode is configured to emit less light in response to the amount of light measured satisfying a low-light threshold.

In some examples, the techniques described herein relate to an attachment, wherein the front surface includes: an alloy chassis, wherein the muzzle aperture with the diameter of at least 5 millimeters is in the alloy chassis, and wherein the muzzle aperture is tapered such that a diameter at a top end of the muzzle aperture located proximate to the alloy chassis is larger than a diameter at a bottom end of the muzzle aperture located distally from the alloy chassis.

In some examples, the techniques described herein relate to an attachment, further including: a polymer shroud including the left surface and the right surface.

In some examples, the techniques described herein relate to an attachment, further including: a guide rod configured to be positioned inside a corresponding guide cavity of the gun, wherein the fastening the attachment with the gun is based on the guide rod being positioned inside the corresponding guide cavity of the gun.

In some examples, the techniques described herein relate to an attachment, further including: a dovetail joint configured to be positioned such that the dovetail joint contacts a corresponding dovetail cavity of the gun, wherein the fastening the attachment with the gun is based on the dovetail joint contacting the corresponding dovetail cavity of the gun.

In some examples, the techniques described herein relate to a method of affixing an attachment to a gun, the method including: aligning a guide rod of the attachment with a cavity of the gun; inserting, based on the aligning the guide rod with the cavity, a protruding rail of the attachment into a complimentary recess of the gun; and fastening the attachment to the gun by causing a locking pin to extend through (i) a first hole of the attachment, (ii) a first hole of a frame of the gun, (iii) a second hole of the frame of the gun, and (iv) a second hole of the attachment such that the locking pin is in contact with both the attachment and the frame of the gun.

In some examples, the techniques described herein relate to a method, further including: coupling an electrical interface of the attachment with an electrical interface of the gun based on the aligning the guide rod of the attachment with the cavity of the gun.

In some examples, the techniques described herein relate to a method, wherein the electrical interface of the attachment includes a male universal serial bus type-C interface, and wherein the electrical interface of the gun includes a female universal serial bus type-C interface.

In some examples, the techniques described herein relate to a method, further including: locking the attachment to the gun by rotating the locking pin a threshold amount.

In some examples, the techniques described herein relate to a method, wherein the threshold amount includes 30 degrees, 45 degrees, 60 degrees, 75 degrees, or 90 degrees.

In some examples, the techniques described herein relate to a method, wherein the protruding rail is located on an exterior surface of the attachment, and wherein the complimentary recess is located on an interior surface of the gun.

In some examples, the techniques described herein relate to a method, wherein a left surface of the attachment includes the exterior surface of the attachment, and wherein a grip sleeve of the gun includes the interior surface of the gun.

In some examples, the techniques described herein relate to a method, wherein the first of the frame of the gun and the second hole of the frame of the gun are located along opposing sides of the frame of the gun, and wherein the first hole of the attachment and the second hole of the attachment are located along opposing sides of the attachment that extend longitudinally along the opposing sides of the frame of the gun.

An attachment for a gun, the attachment comprising: a front surface that comprises an alloy material with an aperture defined therethrough that has a diameter of at least five millimeters, a mounting surface having threads that is oriented circumferentially around a center of the aperture, a left surface with a first aperture defined therein, wherein the left surface is arranged orthogonal to the front surface, a right surface with a second aperture defined therein, wherein the right surface is arranged orthogonal to the front surface and parallel to the left surface, and a locking pin that is operable to be positioned inside the first and second holes, such that the aperture in the front surface envelopes a bore of the gun so as to be aligned with a barrel of the gun.

In some examples, the techniques described herein relate to an attachment for a gun, the attachment including: a front surface including an alloy material, wherein the alloy material includes a muzzle aperture with a diameter of at least 5 millimeters; a mounting surface oriented circumferentially around a center of the muzzle aperture, wherein the mounting surface includes threads; a left surface including a first mounting aperture, the left surface extending from the front surface; a right surface including a second mounting aperture, the right surface extending from the front surface; and a locking pin capable of being positioned in the first mounting aperture and in the second mounting aperture such that the locking pin contacts an interior edge of the first mounting aperture and an interior edge of the second mounting aperture, wherein fastening the attachment with the gun results in the muzzle aperture enveloping a longitudinal bore axis of the gun such that a straight path exists from the longitudinal bore axis through the muzzle aperture.

In some examples, the techniques described herein relate to an attachment for a gun, the attachment including: a front surface including an alloy material, wherein the alloy material includes a muzzle aperture with a diameter of at least 5 millimeters; a mounting surface oriented circumferentially around a center of the muzzle aperture, wherein the mounting surface includes threads; a left surface including a first mounting aperture, the left surface extending from the front surface; a right surface including a second mounting aperture, the right surface extending from the front surface; and a locking pin capable of being positioned in the first mounting aperture and in the second mounting aperture such that the locking pin contacts an interior edge of the first mounting aperture and an interior edge of the second mounting aperture, wherein fastening the attachment with the gun results in the muzzle aperture enveloping a longitudinal bore axis of the gun such that a straight path exists from the longitudinal bore axis through the muzzle aperture.

In some examples, the techniques described herein relate to an attachment, wherein the muzzle aperture includes: a top end located proximate to the front surface; and a bottom end located distally from the front surface, wherein the bottom end is at least a threshold distance from the top end.

In some examples, the techniques described herein relate to an attachment, wherein the threshold distance includes 2 millimeters, 40 millimeters, or anywhere in between.

In some examples, the techniques described herein relate to an attachment, wherein the muzzle aperture is tapered such that a diameter of a top opening located proximate to the front surface is larger than a diameter of a bottom opening located distally from the front surface.

In some examples, the techniques described herein relate to an attachment, wherein the diameter of the bottom opening is at least 5 percent smaller than the diameter of the top opening.

In some examples, the techniques described herein relate to an, wherein the threads are configured to mate with complementary threads of an adapter mechanism, complementary threads of a suppressor, complementary threads of a compensator, or complementary threads of a thread protector.

In some examples, the techniques described herein relate to an attachment, wherein the mounting surface includes an exterior surface, and wherein the exterior surface includes the threads.

In some examples, the techniques described herein relate to an attachment, wherein the exterior surface and the front surface are contiguous.

In some examples, the techniques described herein relate to an attachment, wherein the mounting surface includes an interior surface, and wherein the interior surface includes the threads.

In some examples, the techniques described herein relate to an attachment, wherein the interior surface is located between a top end of the muzzle aperture located proximate to the front surface and a bottom end of the muzzle aperture located distally from the front surface.

In some examples, the techniques described herein relate to an attachment, wherein the threads are configured to mate with the complementary threads of the adapter mechanism such that the adapter mechanism is (i) fastened to the attachment and (ii) exposing an adapter attachment mechanism.

In some examples, the techniques described herein relate to an attachment, wherein the adapter attachment mechanism includes: additional threads or three lugs.

In some examples, the techniques described herein relate to an attachment, wherein the adapter attachment mechanism includes: a pistol located inside a cylindrical alloy spacer.

In some examples, the techniques described herein relate to an attachment, further including: a dovetail joint configured to be positioned such that the dovetail joint contacts a corresponding dovetail cavity of the gun, wherein the fastening the attachment with the gun is based on the dovetail joint contacting the corresponding dovetail cavity of the gun.

In some examples, the techniques described herein relate to an attachment, further including: a guide rod configured to be positioned inside a corresponding guide cavity of the gun, wherein the fastening the attachment with the gun is based on the guide rod being positioned inside the corresponding guide cavity of the gun.

In some examples, the techniques described herein relate to a method of affixing an attachment to a gun, the method including: aligning a guide rod of the attachment with a cavity of the gun; inserting, based on the aligning the guide rod with the cavity, a protruding rail of the attachment into a complimentary recess of the gun; and fastening the attachment to the gun by causing a locking pin to extend through (i) a first aperture of the attachment, (ii) a first aperture of a frame of the gun, (iii) a second aperture of the frame of the gun, and (iv) a second aperture of the attachment such that the locking pin is in contact with both the attachment and the frame of the gun.

In some examples, the techniques described herein relate to a method, further including: locking the attachment to the gun by rotating the locking pin a threshold amount.

In some examples, the techniques described herein relate to a method, wherein the predetermined amount includes 30 degrees, 45 degrees, 60 degrees, 75 degrees, or 90 degrees.

In some examples, the techniques described herein relate to a method, wherein the protruding rail is located on an exterior surface of the attachment, and wherein the complimentary recess is located on an interior surface of the gun.

In some examples, the techniques described herein relate to a method, wherein a left surface of the attachment includes the exterior surface of the attachment, and wherein a grip sleeve of the gun includes the interior surface of the gun.

In some examples, the techniques described herein relate to a method, wherein the attachment includes: an alloy chassis, wherein the guide rod extends from the alloy chassis.

In some examples, the techniques described herein relate to a method, wherein the attachment includes: an alloy chassis including a muzzle aperture with a diameter of at least 5 millimeters.

In some examples, the techniques described herein relate to a method, wherein the muzzle aperture is tapered such that a diameter at a top end of the muzzle aperture located proximate to the alloy chassis is larger than a diameter at a bottom end of the muzzle aperture located distally from the alloy chassis.

Remarks

The Detailed Description provided herein, in connection with the figures, describes example configurations and does not represent all the examples that may be implemented or that are within the scope of the claims. The term "example" used herein means "serving as an illustration or instance," and not "a preferred example."

The functions described herein may be implemented with a controller. A controller may include an attachment manager, a special-purpose processor, a general-purpose processor, a digital signal processor (DSP), a CPU, a graphics processing unit (GPU), a microprocessor, a tensor processing unit (TPU), a neural processing unit (NPU), an image signal processor (ISP), a hardware security module (HSM), an ASIC, a programmable logic device (such as an FPGA), a state machine, a circuit (such as a circuit including discrete hardware components, analog components, or digital components), or any combination thereof. Some aspects of a controller may be programmable, while other aspects of a control may not be programmable. In some examples, a digital component of a controller may be programmable (such as a CPU), and in some other examples, an analog component of a controller may not be programmable (such as a differential amplifier).

In some cases, instructions or code for the functions described herein may be stored on or transmitted over a computer-readable medium, and components implementing the functions may be physically located at various locations. Computer-readable media includes both non-transitory computer storage media and communication media. A non-transitory storage medium may be any available medium that may be accessed by a computer or component. For example, non-transitory computer-readable media may include RAM, SRAM, DRAM, ROM, EEPROM, flash memory, magnetic storage devices, or any other non-transitory medium that may be used to carry and/or store program code means in the form of instructions and/or data structures. The instructions and/or data structures may be accessed by a special-purpose processor, a general-purpose processor, a manager, or a controller. A computer-readable media may include any combination of the above, and a compute component may include computer-readable media.

In the context of the specification, the term "left" means the left side of the gun when the gun is held in an upright position, where the term "upright position" generally refers to a scenario in which the gun is oriented as if in a high-ready position with the barrel roughly parallel to the ground. The term "right" means the right side of the gun when the gun is held in the upright position. The term "front" means the muzzle end (also referred to as the "distal end") of the gun, and the term "back" means the grip end (also referred to as the "proximal end") of the gun. The terms "top" and "bottom" mean the top and bottom of the gun as the gun is held in the upright position. The relative positioning terms such as "left," "right," "front," and "rear" are used to describe the relative position of components. The relative positioning terms are not intended to be limiting relative to a gravitational orientation, as the relative positioning terms are intended to be understood in relation to other components of the gun, in the context of the drawings, or in the context of the upright position described above.

The foregoing description of various embodiments of the claimed subject matter has been provided for the purposes of illustration and description. It is not intended to be exhaustive or to limit the claimed subject matter to the precise forms disclosed. Many modifications and variations will be apparent to one skilled in the art. Embodiments were chosen and described in order to best describe the principles of the invention and its practical applications, thereby enabling those skilled in the relevant art to understand the claimed subject matter, the various embodiments, and the various modifications that are suited to the particular uses contemplated.

Although the Detailed Description describes certain embodiments and the best mode contemplated, the technology can be practiced in many ways no matter how detailed the Detailed Description appears. Embodiments may vary considerably in their implementation details, while still being encompassed by the specification. Particular terminology used when describing certain features or aspects of various embodiments should not be taken to imply that the terminology is being redefined herein to be restricted to any specific characteristics, features, or aspects of the technology with which that terminology is associated. In general, the terms used in the following claims should not be construed to limit the technology to the specific embodiments disclosed in the specification, unless those terms are explicitly defined herein. Accordingly, the actual scope of the technology encompasses not only the disclosed embodiments, but also all equivalent ways of practicing or implementing the embodiments.

The language used in the specification has been principally selected for readability and instructional purposes. It may not have been selected to delineate or circumscribe the subject matter. It is therefore intended that the scope of the technology be limited not by this Detailed Description, but rather by any claims that issue on an application based hereon. Accordingly, the disclosure of various embodiments is intended to be illustrative, but not limiting, of the scope of the technology as set forth in the following claims.

What is claimed is:

1. A method of affixing an attachment to a gun, the method comprising:

aligning a guide rod of the attachment with a cavity of the gun;

inserting, based on the aligning the guide rod with the cavity, a protruding rail of the attachment into a complimentary recess of the gun;

coupling an electrical interface of the attachment with an electrical interface of the gun based on the aligning the guide rod of the attachment with the cavity of the gun; and fastening the attachment to the gun by causing a locking pin to extend through (i) a first hole of the attachment, (ii) a first hole of a frame of the gun, (iii) a second hole of the frame of the gun, and (iv) a second hole of the attachment such that the locking pin is in contact with both the attachment and the frame of the gun.

2. The method of claim 1, wherein the electrical interface of the attachment comprises a male universal serial bus type-C interface, and wherein the electrical interface of the gun comprises a female universal serial bus type-C interface.

3. The method of claim 1, further comprising:

locking the attachment to the gun by rotating the locking pin a threshold amount.

4. The method of claim 3, wherein the threshold amount comprises 30 degrees, 45 degrees, 60 degrees, 75 degrees, or 90 degrees.

5. The method of claim 1, wherein the protruding rail is located on an exterior surface of the attachment, and wherein the complimentary recess is located on an interior surface of the gun.

6. The method of claim 5, wherein a left surface of the attachment comprises the exterior surface of the attachment, and wherein a grip sleeve of the gun comprises the interior surface of the gun.

7. The method of claim 1, wherein the first hole of the frame of the gun and the second hole of the frame of the gun are located along opposing sides of the frame of the gun, and wherein the first hole of the attachment and the second hole of the attachment are located along opposing sides of the attachment that extend longitudinally along the opposing sides of the frame of the gun.

* * * * *